US008960888B2

(12) United States Patent
Yamanobe

(10) Patent No.: US 8,960,888 B2
(45) Date of Patent: Feb. 24, 2015

(54) IMAGE FORMATION DEVICE AND IMAGE FORMATION METHOD

(71) Applicant: Fujifilm Corporation, Tokyo (JP)

(72) Inventor: Jun Yamanobe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 14 days.

(21) Appl. No.: 13/679,850

(22) Filed: Nov. 16, 2012

(65) Prior Publication Data

US 2013/0162712 A1 Jun. 27, 2013

(30) Foreign Application Priority Data

Dec. 21, 2011 (JP) ..... 2011-279852

(51) Int. Cl.
*B41J 2/01* (2006.01)
*B41J 29/38* (2006.01)
*B41J 11/00* (2006.01)

(52) U.S. Cl.
CPC ..... *B41J 11/002* (2013.01)
USPC ..... 347/101; 347/16; 347/14; 347/104

(58) Field of Classification Search
USPC ..... 347/14, 16, 104, 101
See application file for complete search history.

(56) References Cited

U.S. PATENT DOCUMENTS 4,469,026 A * 9/1984 Irwin ..... 101/484
5,099,290 A * 3/1992 Yokota ..... 358/1.12
2006/0023049 A1* 2/2006 Koike et al. ..... 347/104
2007/0257954 A1* 11/2007 Nishizaka et al. ..... 347/14

FOREIGN PATENT DOCUMENTS

JP 2009-066796 A 4/2009

OTHER PUBLICATIONS

The extended European Search Report dated Mar. 22, 2013, which corresponds to EP Application No. 12193212.3-1701 and is related to U.S. Appl. No. 13/679,850.

* cited by examiner

*Primary Examiner* — Sarah Al Hashimi
(74) *Attorney, Agent, or Firm* — Studebaker & Brackett PC

(57) ABSTRACT

An image formation device of the present invention has: a recording medium supplying section that supplies a recording medium; a conveying section that conveys the recording medium supplied from the recording medium supplying section; an image formation section that ejects droplets and forms an image on the recording medium that is being conveyed; an image conversion section that converts an inputted image into dot data; a printing processing section that, from inputted print information, outputs continuously printed number of sheets information that causes the image formation section to continuously print output images, and prints the recording media corresponding to the continuously printed number of sheets, and, thereafter, carries out processing that temporarily stops printing of the output images; and a control section that, during a stoppage time of the printing, stops at least formation of images at the image formation section, and continues to drive the conveying section.

11 Claims, 13 Drawing Sheets

100
12
138K
138Y
138M
138C
158
140
38
38
120A
148
166
166
130
146
132
134
130
130
130

UPPER ROW: VALUE OF sth SHEET
LOWER ROW: SUM UP THROUGH sth SHEET AFTER INTERVAL

| FLOW PATH i | NUMBER OF SHEETS s | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
| 1 | 74 | 88 | 46 | 72 | 62 | 63 | 32 | 96 | 29 | 35 | 22 | 71 | 63 | 77 | 55 | 60 | 59 | 73 | 81 | 66 | 23 | 55 | 71 | 93 | 60 | 76 | 37 | 80 | 77 | 95 | 21 |
| | 74 | 162 | 208 | 280 | 342 | 406 | 438 | 534 | 563 | 599 | 620 | 691 | 754 | 831 | 887 | 947 | 1006 | 1079 | 1160 | 1226 | 1249 | 1304 | 1375 | 1468 | 1527 | 1603 | 1640 | 1720 | 1797 | 1892 | 1913 |
| 2 | 64 | 77 | 76 | 26 | 69 | 96 | 55 | 53 | 58 | 85 | 63 | 68 | 28 | 28 | 45 | 83 | 24 | 73 | 32 | 42 | 44 | 73 | 97 | 88 | 83 | 87 | 76 | 89 | 57 | 21 | 24 |
| | 64 | 141 | 217 | 244 | 313 | 409 | 464 | 516 | 574 | 659 | 723 | 791 | 819 | 847 | 893 | 975 | 999 | 1072 | 1104 | 1146 | 1190 | 1263 | 1359 | 1448 | 1531 | 1618 | 1694 | 1782 | 1839 | 1860 | 1885 |
| 3 | 87 | 23 | 80 | 41 | 93 | 79 | 81 | 56 | 80 | 25 | 78 | 37 | 69 | 95 | 65 | 78 | 35 | 89 | 50 | 29 | 66 | 41 | 58 | 54 | 69 | 70 | 36 | 29 | 34 | 87 | 96 |
| | 87 | 110 | 191 | 232 | 325 | 404 | 485 | 541 | 622 | 646 | 725 | 762 | 830 | 925 | 991 | 1069 | 1103 | 1192 | 1242 | 1272 | 1338 | 1379 | 1437 | 1491 | 1560 | 1630 | 1666 | 1695 | 1729 | 1816 | 1912 |
| 4 | 53 | 92 | 96 | 87 | 65 | 90 | 72 | 21 | 39 | 90 | 30 | 55 | 85 | 83 | 25 | 74 | 52 | 83 | 77 | 33 | 36 | 25 | 82 | 69 | 35 | 91 | 86 | 70 | 78 | 55 | 96 |
| | 53 | 144 | 241 | 327 | 393 | 483 | 555 | 576 | 615 | 705 | 735 | 790 | 874 | 957 | 982 | 1056 | 1108 | 1191 | 1268 | 1301 | 1337 | 1362 | 1444 | 1513 | 1548 | 1639 | 1725 | 1795 | 1874 | 1928 | 2024 |
| 5 | 46 | 31 | 40 | 66 | 99 | 88 | 70 | 39 | 53 | 100 | 97 | 63 | 65 | 46 | 81 | 77 | 52 | 24 | 65 | 85 | 81 | 46 | 91 | 62 | 68 | 71 | 40 | 67 | 37 | 48 | 60 |
| | 46 | 78 | 118 | 184 | 282 | 370 | 440 | 479 | 532 | 632 | 728 | 791 | 857 | 903 | 984 | 1061 | 1113 | 1137 | 1201 | 1287 | 1368 | 1414 | 1505 | 1566 | 1634 | 1705 | 1745 | 1812 | 1849 | 1897 | 1957 |
| 6 | 78 | 83 | 68 | 94 | 34 | 75 | 69 | 29 | 49 | 53 | 33 | 37 | 73 | 68 | 74 | 99 | 21 | 52 | 77 | 89 | 22 | 96 | 32 | 76 | 25 | 69 | 58 | 66 | 79 | 53 | 60 |
| | 78 | 162 | 230 | 324 | 358 | 433 | 502 | 531 | 580 | 633 | 666 | 703 | 776 | 844 | 919 | 1018 | 1039 | 1091 | 1168 | 1257 | 1279 | 1375 | 1407 | 1483 | 1508 | 1577 | 1635 | 1702 | 1781 | 1834 | 1894 |
| MAXIMUM VALUE | 87 | 92 | 96 | 94 | 99 | 96 | 81 | 96 | 80 | 100 | 97 | 71 | 85 | 95 | 81 | 99 | 59 | 89 | 81 | 89 | 81 | 96 | 97 | 93 | 83 | 91 | 86 | 89 | 79 | 95 | 96 |
| | 87 | 162 | 241 | 327 | 393 | 483 | 555 | 576 | 622 | 705 | 735 | 791 | 874 | 957 | 991 | 1069 | 1113 | 1192 | 1268 | 1301 | 1368 | 1414 | 1505 | 1566 | 1634 | 1705 | 1745 | 1812 | 1874 | 1928 | 2024 |

FIG.7B

| FLOW PATH i | NUMBER OF SHEETS s | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
| 1 | 74 | 88 | 46 | 72 | 62 | 63 | 32 | 96 | 29 | 35 | 22 | 71 | 63 | 77 | 55 | 60 | 59 | 73 | 81 | 66 | 23 | 55 | 71 | 93 | 60 | 76 | 37 | 80 | 77 | 95 | 21 |
| | 74 | 162 | 208 | 280 | 342 | 406 | 438 | 534 | 563 | 599 | 620 | 691 | 754 | 77 | 133 | 193 | 252 | 325 | 406 | 472 | 495 | 550 | 621 | 714 | 773 | 849 | 886 | 80 | 157 | 252 | 273 |
| 2 | 64 | 77 | 76 | 26 | 69 | 96 | 55 | 53 | 58 | 85 | 63 | 68 | 28 | 28 | 45 | 83 | 24 | 73 | 32 | 42 | 44 | 73 | 97 | 88 | 83 | 87 | 76 | 89 | 57 | 21 | 24 |
| | 64 | 141 | 217 | 244 | 313 | 409 | 464 | 516 | 574 | 659 | 723 | 791 | 819 | 28 | 73 | 156 | 180 | 253 | 284 | 326 | 371 | 444 | 540 | 628 | 711 | 799 | 874 | 89 | 145 | 167 | 191 |
| 3 | 87 | 23 | 80 | 41 | 93 | 79 | 81 | 56 | 80 | 25 | 78 | 37 | 69 | 95 | 65 | 78 | 35 | 89 | 50 | 29 | 66 | 41 | 58 | 54 | 69 | 70 | 36 | 29 | 34 | 87 | 96 |
| | 87 | 110 | 191 | 232 | 325 | 404 | 485 | 541 | 622 | 646 | 725 | 762 | 830 | 95 | 160 | 239 | 273 | 362 | 412 | 441 | 507 | 549 | 606 | 661 | 730 | 800 | 835 | 29 | 63 | 150 | 246 |
| 4 | 53 | 92 | 96 | 87 | 65 | 90 | 72 | 21 | 39 | 90 | 30 | 55 | 85 | 83 | 25 | 74 | 52 | 83 | 77 | 33 | 36 | 25 | 82 | 69 | 35 | 91 | 86 | 70 | 78 | 55 | 96 |
| | 53 | 144 | 241 | 327 | 393 | 483 | 555 | 576 | 615 | 705 | 735 | 790 | 874 | 83 | 108 | 182 | 233 | 317 | 393 | 427 | 463 | 487 | 570 | 639 | 674 | 765 | 851 | 70 | 148 | 203 | 299 |
| 5 | 46 | 31 | 40 | 66 | 99 | 88 | 70 | 39 | 53 | 100 | 97 | 63 | 65 | 46 | 81 | 77 | 52 | 24 | 65 | 85 | 81 | 46 | 91 | 62 | 68 | 71 | 40 | 67 | 37 | 48 | 60 |
| | 46 | 78 | 118 | 184 | 282 | 370 | 440 | 479 | 532 | 632 | 728 | 791 | 857 | 46 | 128 | 205 | 256 | 280 | 345 | 430 | 511 | 557 | 648 | 710 | 778 | 849 | 889 | 67 | 104 | 151 | 211 |
| 6 | 78 | 83 | 68 | 94 | 34 | 75 | 69 | 29 | 49 | 53 | 33 | 37 | 73 | 68 | 74 | 99 | 21 | 52 | 77 | 89 | 22 | 96 | 32 | 76 | 25 | 69 | 58 | 66 | 79 | 53 | 60 |
| | 78 | 162 | 230 | 324 | 358 | 433 | 502 | 531 | 580 | 633 | 666 | 703 | 776 | 68 | 143 | 242 | 263 | 315 | 392 | 481 | 503 | 599 | 631 | 707 | 732 | 801 | 859 | 66 | 145 | 199 | 259 |
| MAXIMUM VALUE | 87 | 92 | 96 | 94 | 99 | 96 | 81 | 96 | 80 | 100 | 97 | 71 | 85 | 95 | 81 | 99 | 59 | 89 | 81 | 89 | 81 | 96 | 97 | 93 | 83 | 91 | 86 | 89 | 79 | 95 | 96 |
| | 87 | 162 | 241 | 327 | 393 | 483 | 555 | 576 | 622 | 705 | 735 | 791 | 874 | 95 | 160 | 242 | 273 | 362 | 412 | 481 | 511 | 599 | 648 | 714 | 778 | 849 | 889 | 89 | 157 | 252 | 299 |

t1 t2

FIG.9

| | CONDITIONS | | | | ELAPSED TIME (STANDARDIZED WITH PRINTING TIME OF ONE SHEET BEING 1) | | | |

FIG.11

| | CONDITIONS | | | | | ELAPSED TIME (STANDARDIZED WITH PRINTING TIME OF ONE SHEET BEING 1) | | | | | | | | | | | | | | | | | | | |
|---|---|---|---|---|---|---|---|---|---|---|---|---|---|---|---|---|---|---|---|---|---|---|---|---|---|
| | P1 | P2 | M | N | | 1 | 2 | 3 | 4 | 5 | 6 | 7 | 8 | 9 | 10 | 11 | 12 | 13 | 14 | 15 | 16 | 17 | 18 | 19 | 20 |
| EXAMPLE 1 | 2 | 3 | 12 | 2 | ABSENCE/PRESENCE OF PRINTING | P | P | P | P | P | P | P | P | P | P | P | P | D | D | P | P | P | P | P | P |
| | | | | | DRYING SECTION 1 | A | B | A | B | A | B | A | B | A | B | A | B | A | B | A | B | A | B | A | B |
| | | | | | DRYING SECTION 2 | a | b | c | a | b | c | a | b | c | a | b | c | a | b | c | a | b | c | a | b |
| EXAMPLE 2 | 2 | 3 | 16 | 1 | ABSENCE/PRESENCE OF PRINTING | P | P | P | P | P | P | P | P | P | P | P | P | P | P | P | P | D | P | P | P |
| | | | | | DRYING SECTION 1 | A | B | A | B | A | B | A | B | A | B | A | B | A | B | A | B | A | B | A | B |
| | | | | | DRYING SECTION 2 | a | b | c | a | b | c | a | b | c | a | b | c | a | b | c | a | b | c | a | b |
| COMPARATIVE EXAMPLE 1 | 2 | 3 | 11 | 1 | ABSENCE/PRESENCE OF PRINTING | P | P | P | P | P | P | P | P | P | P | P | D | P | P | P | P | P | P | P | P |
| | | | | | DRYING SECTION 1 | A | B | A | B | A | B | A | B | A | B | A | B | A | B | A | B | A | B | A | B |
| | | | | | DRYING SECTION 2 | a | b | c | a | b | c | a | b | c | a | b | c | a | b | c | a | b | c | a | b |
| COMPARATIVE EXAMPLE 2 | 2 | 3 | 13 | 3 | ABSENCE/PRESENCE OF PRINTING | P | P | P | P | P | P | P | P | P | P | P | P | P | D | D | D | P | P | P | P |
| | | | | | DRYING SECTION 1 | A | B | A | B | A | B | A | B | A | B | A | B | A | B | A | B | A | B | A | B |
| | | | | | DRYING SECTION 2 | a | b | c | a | b | c | a | b | c | a | b | c | a | b | c | a | b | c | a | b |
| COMPARATIVE EXAMPLE 3 | 2 | 3 | 14 | 1 | ABSENCE/PRESENCE OF PRINTING | P | P | P | P | P | P | P | P | P | P | P | P | P | P | D | P | P | P | P | P |
| | | | | | DRYING SECTION 1 | A | B | A | B | A | B | A | B | A | B | A | B | A | B | A | B | A | B | A | B |
| | | | | | DRYING SECTION 2 | a | b | c | a | b | c | a | b | c | a | b | c | a | b | c | a | b | c | a | b |

(DRYING SECTION 1 IS ABBREVIATION OF "CONVEYING REGION OF DRYING SECTION 1")
(DRYING SECTION 2 IS ABBREVIATION OF "CONVEYING REGION OF DRYING SECTION 2")

| ELAPSED TIME (STANDARDIZED WITH PRINTING TIME OF ONE SHEET BEING 1) | | | | | | | | | | | | | | | | | | | NOTES | | | | | |
|---|---|---|---|---|---|---|---|---|---|---|---|---|---|---|---|---|---|---|---|---|---|---|---|---|
| 21 | 22 | 23 | 24 | 25 | 26 | 27 | 28 | 29 | 30 | 31 | 32 | 33 | 34 | 35 | 36 | 37 | 38 | 39 | n1 | α1 | n1(mod α1) | n2 | α2 | n2(mod α2) |
| P | P | P | P | P | P | D | D | P | P | P | P | P | P | P | P | P | P | P | 0 | 2 | 0 | 2 | 1 | 0 |
| A | B | A | B | A | B | A | B | A | B | A | B | A | B | A | B | A | B | A | | | | | | |
| c | a | b | c | a | b | c | a | b | c | a | b | c | a | b | c | a | b | c | | | | | | |
| P | P | P | P | P | P | P | P | P | P | P | P | P | D | P | P | P | P | P | 1 | 1 | 0 | 1 | 1 | 0 |
| A | B | A | B | A | B | A | B | A | B | A | B | A | B | A | B | A | B | A | | | | | | |
| c | a | b | c | a | b | c | a | b | c | a | b | c | a | b | c | a | b | c | | | | | | |
| P | P | P | D | P | P | P | P | P | P | P | P | P | P | P | D | P | P | P | 1 | 2 | 1 | 1 | 3 | 1 |
| A | B | A | B | A | B | A | B | A | B | A | B | A | B | A | B | A | B | A | | | | | | |
| c | a | b | c | a | b | c | a | b | c | a | b | c | a | b | c | a | b | c | | | | | | |
| P | P | P | P | P | P | P | P | P | D | D | D | P | P | P | P | P | P | P | 1 | 2 | 1 | 0 | 1 | 0 |
| A | B | A | B | A | B | A | B | A | B | A | B | A | B | A | B | A | B | A | | | | | | |
| c | a | b | c | a | b | c | a | b | c | a | b | c | a | b | c | a | b | c | | | | | | |
| P | P | P | P | P | P | P | P | P | D | P | P | P | P | P | P | P | P | P | 1 | 1 | 0 | 1 | 3 | 1 |
| A | B | A | B | A | B | A | B | A | B | A | B | A | B | A | B | A | B | A | | | | | | |
| c | a | b | c | a | b | c | a | b | c | a | b | c | a | b | c | a | b | c | | | | | | |

FIG.12

| | CONDITIONS | | | | | | ELAPSED TIME (STANDARDIZED WITH PRINTING TIME OF ONE SHEET BEING 1) | | | | | | | | | | | | | | | | | | | | |
|---|---|---|---|---|---|---|---|---|---|---|---|---|---|---|---|---|---|---|---|---|---|---|---|---|---|---|---|
| | P1 | P2 | P3 | M | N | | 1 | 2 | 3 | 4 | 5 | 6 | 7 | 8 | 9 | 10 | 11 | 12 | 13 | 14 | 15 | 16 | 17 | 18 | 19 | 20 |
| COMPARATIVE EXAMPLE 1 | 2 | 3 | 4 | 14 | 2 | ABSENCE/PRESENCE OF PRINTING | P | P | P | P | P | P | P | P | P | P | P | P | P | P | D | D | P | P | P | P |
| | | | | | | DRYING SECTION 1 | A | B | A | B | A | B | A | B | A | B | A | B | A | B | A | B | A | B | A | B |
| | | | | | | DRYING SECTION 2 | a | b | c | a | b | c | a | b | c | a | b | c | a | b | c | a | b | c | a | b |
| | | | | | | DRYING SECTION 3 | α | β | γ | δ | α | β | γ | δ | α | β | γ | δ | α | β | γ | δ | α | β | γ | δ |
| EXAMPLE 1 | 2 | 3 | 4 | 12 | 1 | ABSENCE/PRESENCE OF PRINTING | P | P | P | P | P | P | P | P | P | P | P | P | D | P | P | P | P | P | P | P |
| | | | | | | DRYING SECTION 1 | A | B | A | B | A | B | A | B | A | B | A | B | A | B | A | B | A | B | A | B |
| | | | | | | DRYING SECTION 2 | a | b | c | a | b | c | a | b | c | a | b | c | a | b | c | a | b | c | a | b |
| | | | | | | DRYING SECTION 3 | α | β | γ | δ | α | β | γ | δ | α | β | γ | δ | α | β | γ | δ | α | β | γ | δ |
| COMPARATIVE EXAMPLE 2 | 2 | 3 | 4 | 15 | 1 | ABSENCE/PRESENCE OF PRINTING | P | P | P | P | P | P | P | P | P | P | P | P | P | P | P | D | P | P | P | P |
| | | | | | | DRYING SECTION 1 | A | B | A | B | A | B | A | B | A | B | A | B | A | B | A | B | A | B | A | B |
| | | | | | | DRYING SECTION 2 | a | b | c | a | b | c | a | b | c | a | b | c | a | b | c | a | b | c | a | b |
| | | | | | | DRYING SECTION 3 | α | β | γ | δ | α | β | γ | δ | α | β | γ | δ | α | β | γ | δ | α | β | γ | δ |
| EXAMPLE 2 | 2 | 3 | 4 | 14 | 3 | ABSENCE/PRESENCE OF PRINTING | P | P | P | P | P | P | P | P | P | P | P | P | P | P | D | D | D | P | P | P |
| | | | | | | DRYING SECTION 1 | A | B | A | B | A | B | A | B | A | B | A | B | A | B | A | B | A | B | A | B |
| | | | | | | DRYING SECTION 2 | a | b | c | a | b | c | a | b | c | a | b | c | a | b | c | a | b | c | a | b |
| | | | | | | DRYING SECTION 3 | α | β | γ | δ | α | β | γ | δ | α | β | γ | δ | α | β | γ | δ | α | β | γ | δ |
| EXAMPLE 3 | 2 | 3 | 4 | 12 | 2 | ABSENCE/PRESENCE OF PRINTING | P | P | P | P | P | P | P | P | P | P | P | P | D | D | P | P | P | P | P | P |
| | | | | | | DRYING SECTION 1 | A | B | A | B | A | B | A | B | A | B | A | B | A | B | A | B | A | B | A | B |
| | | | | | | DRYING SECTION 2 | a | b | c | a | b | c | a | b | c | a | b | c | a | b | c | a | b | c | a | b |
| | | | | | | DRYING SECTION 3 | α | β | γ | δ | α | β | γ | δ | α | β | γ | δ | α | β | γ | δ | α | β | γ | δ |

DRYING SECTION 1, DRYING SECTION 2, DRYING SECTION 3 ARE ABBREVIATIONS OF "CONVEYING REGION OF DRYING SECTION 1", "CONVEYING REGION OF DRYING SECTION 2", "CONVEYING REGION OF DRYING SECTION 1", RESPECTIVELY

| ELAPSED TIME (STANDARDIZED WITH PRINTING TIME OF ONE SHEET BEING 1) | | | | | | | | | | | | | | | | | | | NOTES | | | | | | | | |
|---|---|---|---|---|---|---|---|---|---|---|---|---|---|---|---|---|---|---|---|---|---|---|---|---|---|---|---|
| 21 | 22 | 23 | 24 | 25 | 26 | 27 | 28 | 29 | 30 | 31 | 32 | 33 | 34 | 35 | 36 | 37 | 38 | 39 | n1 | α1 | n1 (mod α1) | n2 | α2 | n2 (mod α2) | n3 | α3 | n3 (mod α3) |
| P | P | P | P | P | P | P | P | P | P | D | D | P | P | P | P | P | P | P | 0 | 2 | 0 | 2 | 1 | 0 | 2 | 4 | 2 |
| A | B | A | B | A | B | A | B | A | B | A | B | A | B | A | B | A | B | A | | | | | | | | | |
| c | a | b | c | a | b | c | a | b | c | a | b | c | a | b | c | a | b | c | | | | | | | | | |
| α | β | γ | δ | α | β | γ | δ | α | β | γ | δ | α | β | γ | δ | α | β | γ | | | | | | | | | |
| P | P | P | P | P | D | P | P | P | P | P | P | P | P | P | P | P | P | D | 1 | 1 | 0 | 1 | 1 | 0 | 1 | 1 | 0 |
| A | B | A | B | A | B | A | B | A | B | A | B | A | B | A | B | A | B | A | | | | | | | | | |
| c | a | b | c | a | b | c | a | b | c | a | b | c | a | b | c | a | b | c | | | | | | | | | |
| α | β | γ | δ | α | β | γ | δ | α | β | γ | δ | α | β | γ | δ | α | β | γ | | | | | | | | | |
| P | P | P | P | P | P | P | P | P | P | P | D | P | P | P | P | P | P | P | 1 | 2 | 1 | 1 | 1 | 0 | 1 | 4 | 1 |
| A | B | A | B | A | B | A | B | A | B | A | B | A | B | A | B | A | B | A | | | | | | | | | |
| c | a | b | c | a | b | c | a | b | c | a | b | c | a | b | c | a | b | c | | | | | | | | | |
| α | β | γ | δ | α | β | γ | δ | α | β | γ | δ | α | β | γ | δ | α | β | γ | | | | | | | | | |
| P | P | P | P | P | P | P | P | P | P | P | D | D | D | P | P | P | P | P | 1 | 1 | 0 | 0 | 1 | 0 | 3 | 1 | 0 |
| A | B | A | B | A | B | A | B | A | B | A | B | A | B | A | B | A | B | A | | | | | | | | | |
| c | a | b | c | a | b | c | a | b | c | a | b | c | a | b | c | a | b | c | | | | | | | | | |
| α | β | γ | δ | α | β | γ | δ | α | β | γ | δ | α | β | γ | δ | α | β | γ | | | | | | | | | |
| P | P | P | P | P | P | D | D | P | P | P | P | P | P | P | P | P | P | P | 0 | 2 | 0 | 2 | 1 | 0 | 2 | 2 | 0 |
| A | B | A | B | A | B | A | B | A | B | A | B | A | B | A | B | A | B | A | | | | | | | | | |
| c | a | b | c | a | b | c | a | b | c | a | b | c | a | b | c | a | b | c | | | | | | | | | |
| α | β | γ | δ | α | β | γ | δ | α | β | γ | δ | α | β | γ | δ | α | β | γ | | | | | | | | | |

IMAGE FORMATION DEVICE AND IMAGE FORMATION METHOD

CROSS-REFERENCE TO RELATED APPLICATION

This application claims priority under 35 USC 119 from Japanese Patent Application No. 2011-279852 filed Dec. 21, 2011, the disclosure of which is incorporated by reference herein.

BACKGROUND

1. Technical Field

The present invention relates to an image formation device and an image formation method.

2. Related Art

In an inkjet-recording-type image formation device, there is the problem that, when ink is ejected continuously, poor ejection of ink occurs. This is particularly marked in cases in which a large amount of ink is ejected from the nozzles. In such cases, it is possible to restore good ejection quality by providing an appropriate stoppage time. However, if printing is stopped too frequently, the total printing speed (throughput) when printing the needed number of sheets decreases, and the burden on the user increases.

The following two factors are considered as main causes of a decrease in throughput due to the provision of stoppage time. (1) In the first place, printing is not carried out during the stoppage time. (2) Immediately after the stoppage time ends and there is a return to printing, preparation time is needed, and printing cannot be carried out during this preparation time.

In the case of inkjet-recording-type image formation devices for so-called "home use" that are conventionally used, the image formation device is compact, the operation of the conveying system is simple, and a heating/drying section is not provided. Therefore, aforementioned factor (2) substantially hardly ever arises.

On other hand, in recent years, the application of inkjet image formation devices for use as commercial printers (digital printers) or as printers for office use has expanded. It is often the case that image formation devices that are used in such applications are large, and are provided with a heating/drying section and a fixing section. Therefore, aforementioned factor (2) becomes problematic.

As a technique of providing a stoppage time during the printing operation, there is the technique disclosed in Japanese Patent Application Laid-Open (JP-A) No. 2009-66796.

JP-A No. 2009-66796 discloses a technique in which sheets, on which ink or toner has been printed but is still in an unfixed (undried) state, are stacked in a sheet discharging section, and, in order to prevent the ink or toner from dirtying other printed matter, a predetermined stoppage time is provided, on the basis of the amount of ink that is used during printing, from the end of the printing processing of this time (the Nth sheet) until the start of the printing processing of the next time (the (N+1)st sheet).

However, the technique disclosed in JP-A No. 2009-66796 is a technique whose object is the prevention of soiling by undried ink after printing, and therefore, the printing operation is stopped during the stoppage time. Thus, even if this technique is applied as a means for solving the problem of poor ejection due to continuous printing, the printing operation is stopped during the stoppage time. Therefore, above-described factor (2) remains as it did before, and the object of suppressing a decrease in throughput cannot be achieved.

SUMMARY

In consideration of the above-described circumstances, the present invention provides an image formation device and an image formation method that prevent poor ejection due to continuous printing, while suppressing a decrease in throughput.

An image formation device of a first aspect of the present invention has: a recording medium supplying section that supplies a recording medium; a conveying section that conveys the recording medium supplied from the recording medium supplying section; an image formation section that ejects droplets and forms an image on the recording medium that is being conveyed; an image conversion section that converts an inputted image into dot data; a printing processing section that, from inputted print information, outputs continuously printed number of sheets information that causes the image formation section to continuously print output images, and prints the recording media corresponding to the continuously printed number of sheets, and, thereafter, carries out processing that temporarily stops printing of the output images; and a control section that, during a stoppage time of the printing, stops at least formation of images at the image formation section, and continues to drive the conveying section.

In accordance with the first aspect of the present invention, a recording medium is fed by the recording medium supplying section, and the recording medium is conveyed by the conveying section. Further, an inputted image is converted into dot data by the image conversion section, and droplets are ejected and an image is formed on the recording medium by the image formation section.

Further, continuously printed number of sheets information, that causes the image formation section to continuously print output images from inputted print information, and the continuously printed number of sheets are printed by the printing processing section. Thereafter, processing that temporarily stops printing of the output images is carried out by the printing processing section. Further, during a stoppage time of the printing, at least formation of images at the image formation section is stopped, and the conveying section is continued to be driven, by the control section.

Due to the structure of the first aspect of the present invention, stoppage time of the image formation section is ensured, and poor ejection from nozzles is suppressed. Moreover, because the conveying section continues driving even during the stoppage time, a delay in printing, that is needed for shut-down and start-up of the conveying section before and after the image formation section is stopped (a delay in printing due to conveying preparations), is suppressed, and a deterioration in throughput is suppressed.

A second aspect of the present invention has the feature that, in the first aspect of the present invention, the printing processing section computes the continuously printed number of sheets and the stoppage time on the basis of the dot data.

Due thereto, a continuously printed number of sheets and a stoppage time, that are more precise and that are based on the output images, can be computed, and a deterioration in throughput is suppressed.

A third aspect of the present invention has the feature that, in the first aspect of the present invention, a drying section, that dries the recording medium while conveying the recording medium, is provided at a conveying direction downstream side of the image formation section, the control section has a drying operation control section that switches operation of the drying section between a first operation at a time of printing, and a second operation at a time of warm-up at which drying energy is lower than drying energy of the first operation, and the drying operation control section continues to maintain the drying section in the first operation during the stoppage time.

In accordance with the third aspect of the present invention, the drying section that dries the output images is provided at the conveying direction downstream side of the image formation section. Switching between a first operation at a time of printing, and a second operation at a time of warm-up at which drying energy is lower than the drying energy of the first operation, is carried out by the drying operation control section that is provided at the control section.

Note that the drying operation control section maintains the drying section in the first operation during the stoppage time.

Due thereto, a delay in printing, that is caused by preparations for drying at times of shut-down and start-up of the conveying section before and after the stoppage time, is suppressed, and the throughput is ensured.

An image formation method of a fourth aspect of the present invention includes: a step in which an image conversion section converts an inputted image into dot data; a step in which a printing processing section, from inputted print information, outputs continuously printed number of sheets information that causes an image formation section to continuously form output images, and prints the continuously printed number of sheets, and, thereafter, outputs stoppage time information that stops printing of the output images; a step in which a control section executes printing of the continuously printed number of sheets by causing a recording media supplying section to supply recording media, and causing a conveying section to convey the recording media, and causing the image formation section to form images on the recording media by a droplet ejection head; and a step in which the control section, after printing the continuously printed number of sheets, during the stoppage time, stops at least formation of images at the image formation section, and continues to drive the conveying section.

In accordance with the fourth aspect of the present invention, stoppage time of the image formation section is ensured, and poor ejection from nozzles is suppressed. Moreover, because the conveying section continues driving even during the stoppage time, a delay in printing, that is needed for shut-down and start-up of the conveying section before and after the image formation section is stopped (a delay in printing due to conveying preparations), is suppressed, and a deterioration in throughput is suppressed.

A fifth aspect of the present invention has the feature that, in the fourth aspect of the present invention, a drying section, that dries the recording media while conveying the recording media, is provided at a conveying direction downstream side of the image formation section, and the drying section has plural conveying regions on which the recording media are conveyed, and, given that a number of the conveying regions is P, where $P \geq 2$, and that the continuously printed number of sheets is M, and that a number of sheets in terms of recording media, that is obtained by dividing the stoppage time by a printing time per recording medium, is N, the printing processing section determines the number P of the conveying regions, the continuously printed number of sheets M, and the number of sheets N in terms of recording media so as to satisfy following formula (1):

$$n(\text{mod } \alpha)=0 \quad (1)$$

where n: a remainder when N is divided by P ($n=N(\text{mod}P)$)

$\alpha$: a greatest common factor of P and (M+N).

In accordance with the fifth aspect of the present invention, it is investigated whether or not the remainder n, when the number of sheets N in terms of recording media is divided by the number P of conveying regions, is divisible by the greatest common factor $\alpha$ of the number P of conveying regions and (the continuously printed number of sheets M+the number of sheets N in terms of recording media), i.e., it is investigated whether or not $n(\text{mod } \alpha)=0$. By employing the condition that n is divisible by $\alpha$, at the drying section, a situation in which only a specific drying/conveying section continues to be heated does not occur, and the outputted states (curled states) of the papers can be kept substantially uniform.

A sixth aspect of the present invention has the feature that, in the fourth aspect of the present invention, plural drying sections, that dry the recording media while conveying the recording media, are provided at a conveying direction downstream side of the image formation section, and the plural drying sections have one or more conveying regions on which the recording media are conveyed, and given that a number of the conveying regions at a jth drying section, among drying sections whose number of the conveying regions is greater than or equal to 2, is $P_j$ ($P_j \geq 2$), and that a number of sheets in terms of recording media, that is obtained by dividing the stoppage time by a printing time per one recording medium, is N, and that the continuously printed number of sheets is M, the printing processing section determines the number $P_j$ of the conveying regions, the number of sheets N in terms of recording media, and the continuously printed number of sheets M so as to satisfy following formula (2):

$$n_j(\text{mod } \alpha_j)=0 \quad (2)$$

where $n_j$: a remainder when N is divided by $P_j$($n_j=(\text{mod}P_j)$)

$\alpha_j$: a greatest common factor of $P_j$ and (M+N).

In accordance with the sixth aspect of the present invention, it is investigated whether or not the remainder $n_j$, when the number of sheets N in terms of recording media is divided by the number $P_j$ of conveying regions, is divisible by the greatest common factor $\alpha_j$ of the number $P_j$ of conveying regions and (the continuously printed number of sheets M+the number of sheets N in terms of recording media), i.e., it is investigated whether or not $n_j(\text{mod } \alpha_j)=0$. By employing the condition that $n_j$ is divisible by $\alpha_j$, at the drying sections, a situation in which only a specific drying/conveying section continues to be heated does not occur, and the outputted states (curled states) of the papers can be kept substantially uniform.

A seventh aspect of the present invention has the feature that, in the fourth aspect of the present invention, the droplet ejecting head has i branches that are branched-off from a common flow path, and k nozzles provided at each of the branches, and given that an ejected ink total amount of an ith ($i=1, 2, \ldots, I$) branch that is computed on the basis of the dot data is $V_i$, the printing processing section determines the continuously printed number of sheets M on the basis of the ejected ink total amount $V_i$ and an ejectable ink total amount V at which continuous printing is possible at the branch.

Due thereto, poor ejection, that is predicted per branch, can be dealt with appropriately.

An eighth aspect of the present invention has the feature that, in the seventh aspect of the present invention, given that a maximum value among the ejected ink total amounts $V_i$ is maximum ejected ink total amount Vmax, the printing processing section determines the continuously printed number of sheets M on the basis of the maximum ejected ink total amount Vmax and the ejectable ink total amount V at which continuous printing is possible at the branch.

Due thereto, poor ejection, that is predicted at the nozzles connected to the respective branches, can be dealt with appropriately by simple computation.

A ninth aspect of the present invention has the feature that, in the seventh aspect of the present invention, given that an average of R ejected ink total amounts $V_i$, that are selected in order from a greatest ejected ink total amount among the ejected ink total amounts $V_i$, is average ejected ink total amount Vave, the printing processing section determines the continuously printed number of sheets M on the basis of the average ejected ink total amount Vave and the ejectable ink total amount V at which continuous printing is possible at the branches.

Due thereto, poor ejection, that is predicted at the nozzles connected to the respective branches, can be dealt with more effectively and by simple computation.

A tenth aspect of the present invention has the feature that, in the seventh aspect of the present invention, the ejectable ink total amount V is determined by multiplication by a factor that is determined on the basis of an arrayed order from an upstream side of the common flow path.

Due thereto, the effects of poor ejection, that is predicted at the nozzle groups connected to the respective branches, can be estimated more effectively, and can be dealt with appropriately.

An eleventh aspect of the present invention has the feature that, in the tenth aspect of the present invention, given that K nozzles that are common to a branch are k=1, 2, . . . , K in order from the common flow path, and that an ink ejection amount from a Kth nozzle of an ith branch is $V^i_k$, the ejected ink total amount Vi from the branch is computed by following formula (3):

$$Vi = \sum_{k=1}^{k} \alpha(k) V_k^i \tag{3}$$

where $\alpha(k)$ is a weighting parameter that satisfies the following:

for k=1, 2, . . . , K−1, $0 \le \alpha(k) \le \alpha(k+1)$.

Due thereto, weights, within the common flow path, for poor ejection that is predicted at the nozzles connected to the respective branches, can be estimated by simple computation, and poor ejection can be dealt with.

A twelfth aspect of the present invention has the feature that, in the fourth aspect of the present invention, the droplet ejecting head has i branches that are branched-off from a common flow path, and k nozzles provided at each of the branches, and given that an ejected ink total amount of an ith (i=1, 2, . . . , I) branch that is computed on the basis of the dot data is $V_i$, when printing a different image per recording medium, the printing processing section adds-up the ejected ink total amounts Vi, from a start of printing through an sth recording medium, of the ith branch so as to compute a cumulative ink ejection amount Vit, and the printing processing section makes M be a continuously printed number of sheets at which the cumulative ink ejection amount Vit does not exceed the ejectable ink total amount V at which continuous printing is possible at the branch.

Due thereto, even in cases in which different images are printed continuously, poor ejection, that is predicted at the nozzles connected to the respective branches, can be dealt with appropriately. Note that the start of printing includes not only the start of printing of the first recording medium, but also the start of printing at the time of restarting after stoppage.

BRIEF DESCRIPTION OF THE DRAWINGS

Exemplary embodiments of the present invention will be described in detail based on the following figures, wherein:

FIG. 7B is an explanatory diagram showing trial computation examples of a converted ink amount per flow path of the image formation device relating to the first exemplary embodiment of the present invention;

FIG. 9 is an analysis table in which relationships between a continuously printed number of sheets and a number of sheets for which printing is stopped after continuous printing, in the image formation device relating to the second exemplary embodiment of the present invention, have been trial computed;

FIG. 11 is an analysis table in which relationships between a continuously printed number of sheets and a number of sheets for which printing is stopped after continuous printing, in the image formation device relating to the third exemplary embodiment of the present invention, have been trial computed; and FIG. 12 an analysis table in which relationships between a continuously printed number of sheets and a number of sheets for which printing is stopped after continuous printing, in the image formation device relating to the third exemplary embodiment of the present invention, have been trial computed.

DETAILED DESCRIPTION

<Overall Structure of Image Formation Device>

Figure 1:
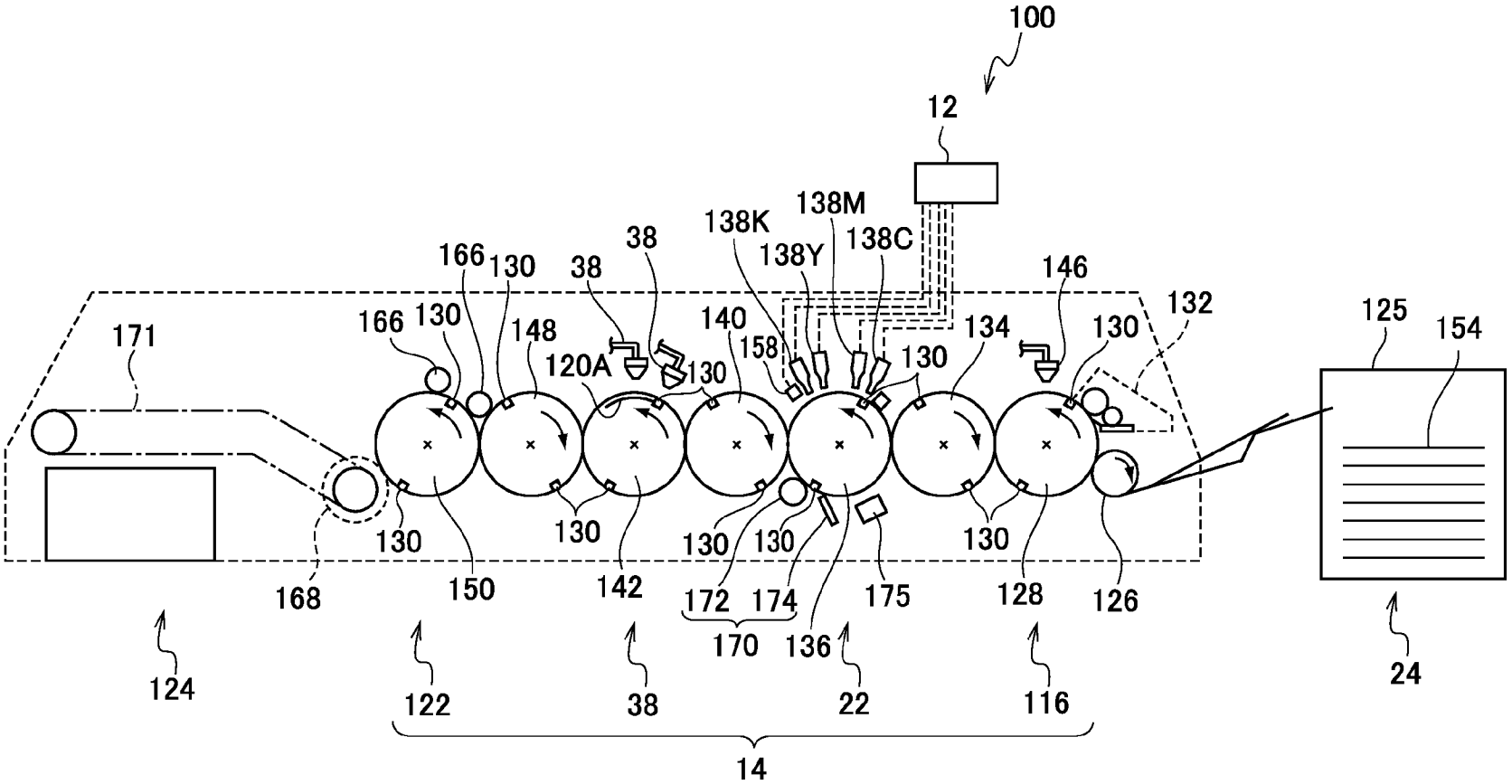
FIG. 1 is a schematic structural drawing showing the basic structure of a general image formation device.

A general inkjet-recording-type image formation device 100 is shown in FIG. 1. This image formation device 100 has a sheet feeding section 24, a processing liquid coating section 116, an inkjet recording head 22, a drying section 38, a fixing section 122, and a sheet discharging section 124. The processing liquid coating section 116, the inkjet recording head 22, the drying section 38 and the fixing section 122 structure a conveying section 14.

The image formation device 100 is a device that records an output image on a sheet 154, that is an example of a recording medium, while conveying the sheet 154 in order along these regions.

At the sheet feeding section 24, the plural sheets 154 are stacked on a sheet feed tray 125, and the sheets 154 are fed-out one-by-one. The sheet 154 that has been fed-out is conveyed to the processing liquid coating section 116 via a sheet feeding drum 126.

Plural types of the sheets 154 having different paper types and sizes (media sizes) can be used as the sheets 154. Hereinafter, a case in which cut sheets are used as the sheets 154 is described as an example.

A processing liquid coating drum 128 is disposed rotatably at the processing liquid coating section 116. The sheet 154 is conveyed toward the downstream side due to the rotation of the processing liquid coating drum 128 in a state in which the leading end of the sheet 154 is held by claw-shaped holding members 130 (grippers) that are provided at the processing liquid coating drum 128. Further, processing liquid is coated on the sheet 154 by a processing liquid coating device 132 that is disposed at the upper portion of the processing liquid coating drum 128.

The processing liquid, that is coated on the sheet 154 at the processing liquid coating section 116, contains components that agglomerate or thicken the color material (pigment or dye) within the ink that is applied onto the sheet 154 by the inkjet recording head 22. Due to this processing liquid and the ink contacting one another, separation of the color material and the solvent of the ink is promoted.

Concrete examples of processing liquids that agglomerate or thicken the color material include processing liquids that react with the ink and precipitate or insolubilize the color material within the ink, processing liquids that generate a semi-solid substance (gel) that contains the color material within the ink, and the like. Further, examples of means of bringing about the reaction between the ink and the processing liquid include: a method of causing a cationic compound within the processing liquid to react with an anionic color material within the ink; a method of, by mixing together an ink and a processing liquid that have different pHs, changing the pH of the ink, and causing dispersion destruction of the pigment within the ink, and agglomerating the pigment; a method of causing dispersion destruction of the pigment within the ink by a reaction with a polyvalent metal salt within the processing liquid, and agglomerating the pigment; and the like.

Methods of applying the processing liquid include droplet ejection by ejecting the processing liquid from an inkjet head, application by a roller, uniform application by spraying, and the like.

The processing liquid coating section 116 has a processing liquid drying device 146 at a position facing the outer peripheral surface of the processing liquid coating drum 128. The solvent component within the processing liquid applied on the sheet 154 is dried at the processing liquid drying device 146. Due thereto, floating of color material (the phenomenon of pixels that are formed by ink drops not being formed at the desired positions due to the ink drops floating on the processing liquid) can be suppressed.

Next, the sheet 154 is sent, via a conveying drum 134, to the inkjet recording head 22. At the inkjet recording head 22, an image is recorded on the surface of the sheet 154 due to ink drops, that are ejected from droplet ejecting heads 138 that are disposed above a drum 136 for image recording, being applied while the sheet 154 is held and conveyed by the drum 136 for image recording. The drum 136 for image recording is rotated in an arrow R3 direction by a motor and the like, and also serves as a relative moving means in the present invention.

In the present exemplary embodiment, droplet ejecting heads 138K, 138Y, 138M, 138C of the four colors of K (black), Y (yellow), M (magenta) and C (cyan) that are basic colors are disposed along the peripheral direction of the drum 136 for image recording. Each of the droplet ejecting heads 138 has an ink ejection range that corresponds to the maximum width of the sheet 154, i.e., is a full-line head.

In particular, in the present exemplary embodiment, as described above, the processing liquid, that is conveyed with the color material within the ink, is applied in advance onto the sheet 154 by the processing liquid coating section 116. Therefore, the color material within the ink agglomerates (or thickens), and bleeding can be suppressed.

Figure 2:
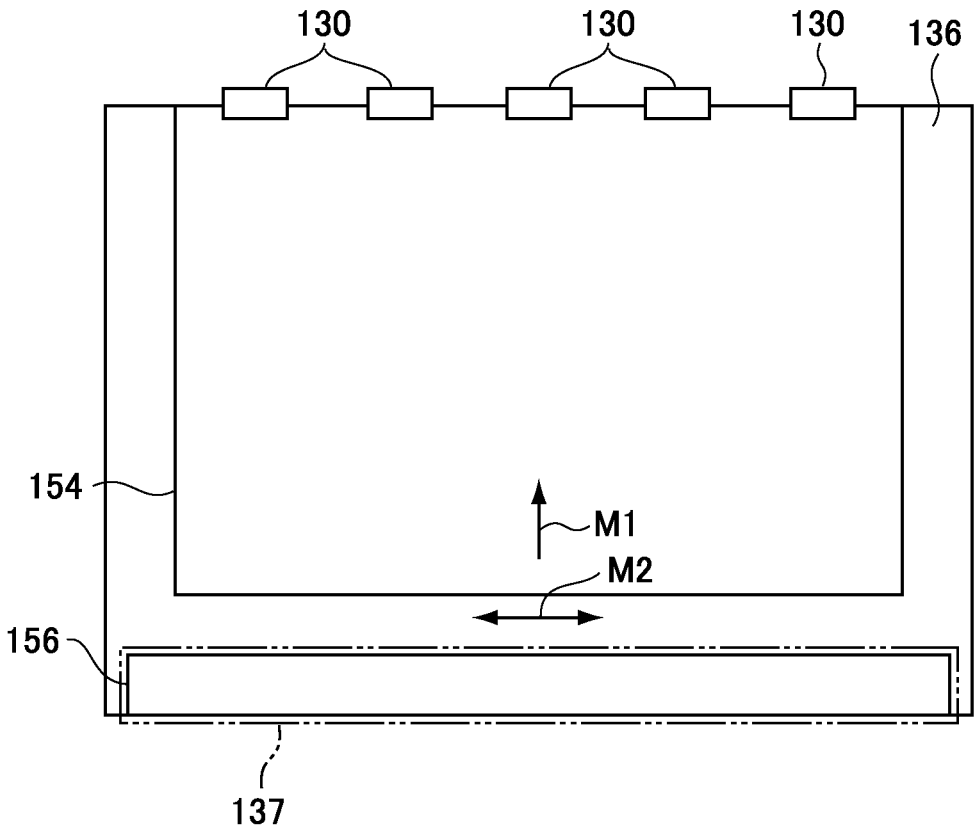
FIG. 2 is an expanded drawing of a drum for image recording of the general image formation device.

FIG. 2 shows a state in which the surface of the drum 136 for image recording is unfolded in the peripheral direction, at the image formation device 100 of the first exemplary embodiment of the present invention.

As shown in FIG. 2, an image formation region 137 for checking is set at the drum 136 for image recording of the inkjet recording head 22, at a portion where the sheet 154 that is held thereon does not exist (in the example of FIG. 2, further toward the rear side in the conveying direction (shown by arrow MO than the sheet 154). Further, as will be described in detail later, at the drum 136 for image recording, ink drops are ejected from the droplet ejecting heads 138Y, 138M, 138C, 138K at a predetermined timing and in a predetermined pattern such that an image (check pattern) 156 for checking, that is described later, is formed at this image formation region 137 for checking.

Note that, in FIG. 1, a structure (a 2× drum) is illustrated in which two of the sheets 154 can be disposed per one circumference of the single drum 136 for image recording. However, the drum for image recording may be a structure (a 1× drum, see FIG. 2) at which only one of the sheets 154 can be disposed, or may be a structure (a 3× drum, not illustrated) at which three of the sheets 154 can be disposed, or may be a structure at which four or more of the sheets 154 can be disposed.

The inkjet recording head 22 further has an image reading section 158 for checking. The image 156 for checking, that is formed on the image formation region 137 for checking of the drum 136 for image recording by the droplet ejecting heads 138K, 138Y, 138M, 138C, is read by the image reading section 158 for checking. The image reading section 158 for checking can read the shape and the color shade of the image for checking, bleeding and blurring of ink, and the like, and a CCD line sensor or the like is used as the sensor for reading.

The read data is sent to a control device 160, and the states of the nozzles (e.g., bending of the ink ejecting direction, non-ejection, or the like) are detected. Then, nozzles, at which the value of the state detection is worse than a predetermined threshold value, are extracted as faulty nozzles, and the control device 160 corrects the output image by the processes that are described later, so that the effects of the faulty nozzles are reduced (preferably, become invisible).

Note that, when a faulty nozzle is detected, the aforementioned image correction has not been carried out on the sheets 154 on which image recording was carried out therebefore, and therefore, a predetermined stamping processing (spoilage processing) may be carried out on the sheets 154 by an unillustrated stamping processing device or the like. Due to this stamping processing, it is indicated that an image, for which correction has not been carried out, is recorded.

The inkjet recording head 22 further has an image removing member 170 for checking. The image removing member 170 for checking carries out removal processing for removing, from the drum 136 for image recording, the image 156 for checking that is formed on the drum 136 for image recording.

In the present exemplary embodiment, the image removing member 170 for checking has a cleaning liquid coating roller 172 and an ink removal blade 174.

The cleaning liquid coating roller 172 transfers and coats, onto the surface of the drum 136 for image recording, cleaning liquid that is supplied from an unillustrated cleaning liquid supply section. It is preferable that the cleaning liquid be more alkaline than the ink. By making the cleaning liquid be more alkaline than the ink, re-dispersion of the color material is promoted, and it is easy to remove the image 156 for checking.

Note that the cleaning liquid may be coated onto the drum 136 for image recording by ejecting the cleaning liquid from nozzles, instead of (or together with) the cleaning liquid coating roller 172.

The ink removal blade 174 is formed from a material that is elastic such as rubber or the like, and in the shape of a plate that has a width that is greater than or equal to the width of the image 156 for checking. When the ink removal blade 174 is pressed against the surface of the drum 136 for image recording, the ink that forms the image 156 for checking is scraped-off. Note that cleaning liquid may be applied in advance onto the ink removal blade 174, and the coating of the cleaning liquid and the removal of the ink may be carried out simultaneously by the ink removal blade 174.

Before removal by the ink removal blade 174, the ink of the image 156 for checking may be heated so as to reduce the adhesive force of the ink with respect to the drum 136 for image recording. Further, after removal of the ink by the ink removal blade 174, the cleaning liquid remaining on the drum 136 for image recording may be dried by, for example, the blowing-out of warm air or the like.

The method of removing ink from the drum 136 for image recording is not limited to the above-described method, and, for example, cleaning by rubbing servicing or cleaning by ink transfer onto a roller or the like may be carried out. Further, the ink may be removed by decomposition of the dye by irradiation of energy, or the like. Moreover, by decomposing the dye by irradiating energy onto the ink, the ink is made to be invisible (to the image reading sensor 158 for checking that is described later), and such a method is included in what is called here the removal (cleaning) of the image for checking.

An ink detecting sensor 175, that detects the extent to which ink remains on the drum 136 for image recording after removal of the image 156 for checking is carried out by the image removing member 170 for checking, may be provided.

The above example describes an aspect in which the image for checking is recorded on the drum for image recording, but the image for checking may be recorded on a non-image recording portion of the recording medium 154 (e.g., an end portion of the recording medium).

The sheet 154, on which an image has been recorded by the inkjet recording head 22, is sent via a conveying drum 140 to the drying section 38. At the drying section 38, the solvent (moisture) within the ink is dried while the sheet 154 is conveyed while being held at a drum 142 for drying.

The drying section 38 has a first drying means 38A, that is disposed at the inner side of the drum 142 for drying and dries the solvent from the side opposite the image recording surface of the sheet 154, and a second drying means 38B, that is disposed at the outer side of the drum 142 for drying and dries the solvent from the image recording surface of the sheet 154. Concretely, a structure that pushes a heating member against the sheet 154 from the side opposite the image recording surface of the sheet 154 and supplies heat by contact thermal conduction, or the like is used as the first drying means 38A. A structure that irradiates warm air from the image recording surface side of the sheet 154, or the like is used as the second drying means 38B. More concretely, in addition to these, a structure that supplies heat by radiation by a carbon heater or a halogen heater or the like may be used.

It is preferable that the remaining amount of moisture after drying of the solvent (moisture) within the ink by the drying section 38 is greater than or equal to 1 $g/m^2$ and less than 3.5 $g/m^2$. If moisture in an amount of greater than or equal to 3.5 $g/m^2$ remains, there is the concern that offset toward unillustrated fixing rollers will arise. Further, if less than or equal to 1 $g/m^2$ of moisture remains, the moisture that has seeped into the sheet 154 also is evaporated, and therefore, a large amount of energy is needed.

The temperatures of a first drying means 38A and the second drying means 38B are sensed by temperature sensors that are incorporated therein, and are sent to the control device 160 as temperature information. Various drying conditions are realized by the control device 160 appropriately adjusting the temperatures of the first drying means 38A and the second drying means 38B on the basis of this temperature information.

The sheet 154, at which the solvent (moisture) within the ink has been dried by the drying section 38 is sent via a conveying drum 148 to the fixing section 122. At the fixing section 122, the image (ink) is fixed by heating and press-contacting by a fixing roller 166. Concretely, due to the fixing roller 166 being made to contact the surface of the sheet 154 at, for example, a temperature of around 75° C. and a pressure of around 0.3 MPa, the polymer resin particles (latex) contained in the ink are fused, and the adhesive force thereof with the sheet 154 is increased. Note that, if the temperature of the fixing roller 166 at the time of the fixing processing is made to be higher than the glass transition temperature of latex, the latex can be more effectively fused at the time of the fixing processing, which is preferable.

The sheet 154, on which an image has been recorded in this way, is further conveyed from a discharge roller 168 by a discharge belt 171, and is discharged, via the sheet discharge section 124, from the image formation device 100. Plural sheets are stacked at the sheet discharge section 124.

First Exemplary Embodiment

Figure 3:
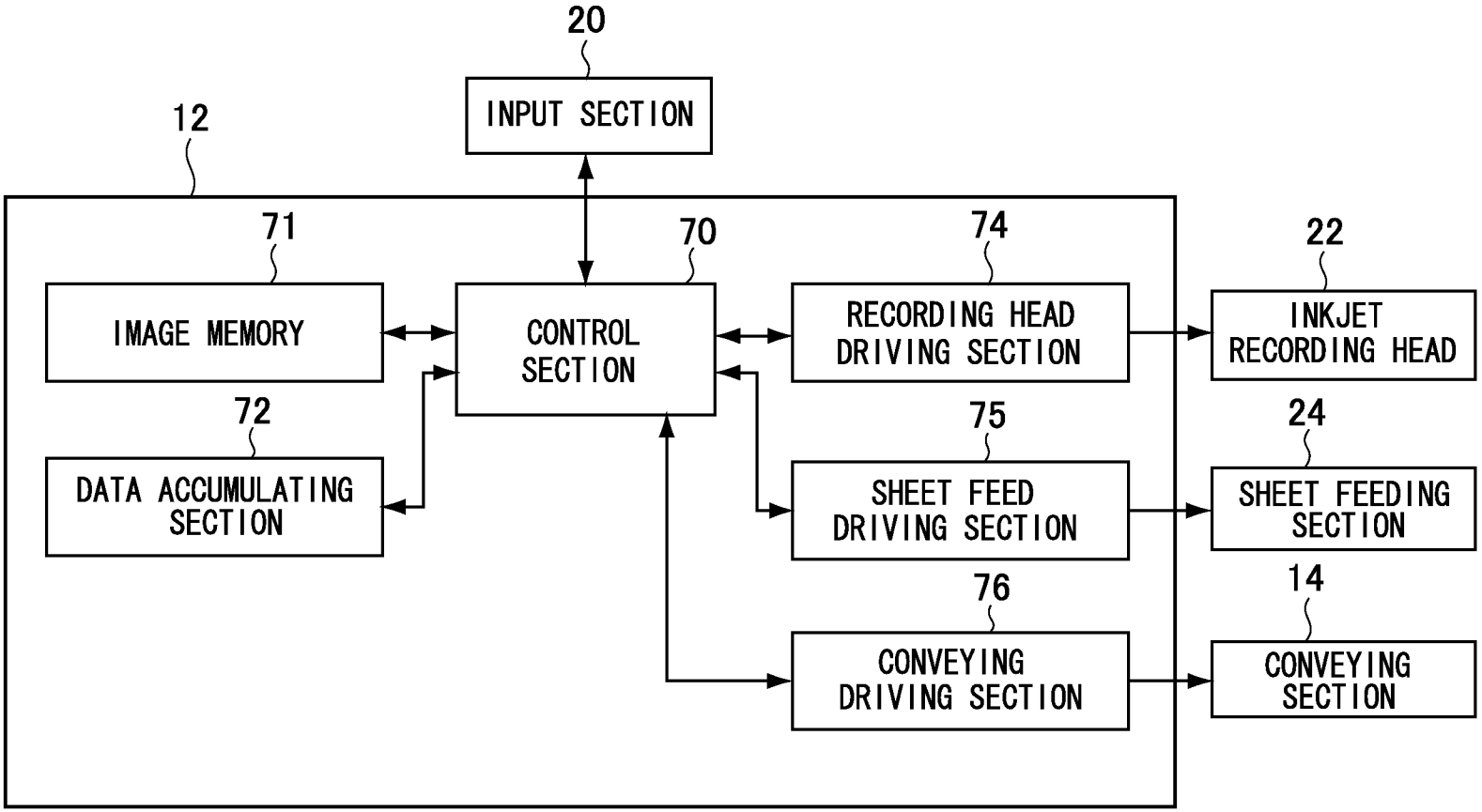
FIG. 3 is a block diagram showing the basic structure of a control device of an image formation device relating to a first exemplary embodiment of the present invention.

An image formation method relating to a first exemplary embodiment is a method of controlling the image formation device by a control device 12 that is shown in the block diagram of FIG. 3.

Provided at the control device 12 are a control section 70 that has a CPU, a ROM and a RAM and that executes programs for processing of the image formation device 100, an image memory 71 that stores image data and the like, a data accumulating section 72 that stores data that is computed for printing processing, a recording head driving section 74 that drives the inkjet recording head 22, a sheet feed driving section 75 that drives the sheet feeding section 24, and a conveying driving section 76 that drives the conveying section 14. The processing programs are stored in the ROM that serves as a memory medium.

As is described later, the control section 70 executes various types of processings such as: printing processing that, from print information inputted from an input section 20, prints continuously printed number of sheets information that causes the inkjet recording head 22 to continuously print output images, and prints the continuously printed number of sheets, and, thereafter, outputs stoppage time information that causes printing of output images to be stopped temporarily; image conversion that converts an inputted image, that is inputted from the input section 20, into dot data; during the stoppage time, stopping at least the formation of images at the inkjet recording head 22, and continuing to drive the conveying section 14; and the like.

Note that, in the present specification, for convenience of explanation, the region that carries out image conversion processing in the processing program is called the image conversion section, the region that carries out the processing of the print information is called the printing processing section, and the region that carries out drying operation control is called the drying operation control section.

Figure 4:
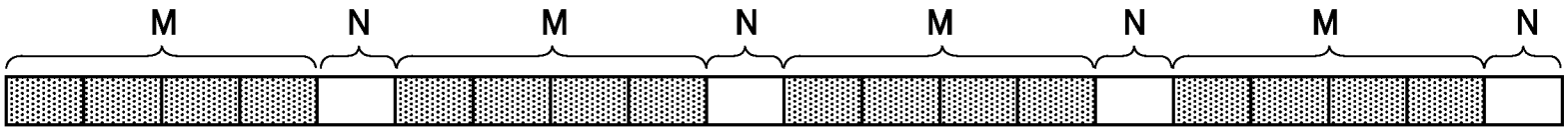
FIG. 4 is a schematic drawing showing a printing method in accordance with the image formation device relating to the first exemplary embodiment of the present invention.

Namely, as shown in FIG. 4, the image formation device 100 of the present exemplary embodiment effects control so as to, after continuously printing a continuously printed number of sheets M, provide a stoppage time of predetermined time N in which printing is not carried out, and, after the stoppage time that is the predetermined number of sheets N, further carry out continuous printing of the continuously printed number of sheets M.

Note that, with regard to stoppage time t, the stoppage time information is shown in a state in which the unit thereof is the printing time per one sheet.

Figure 5:
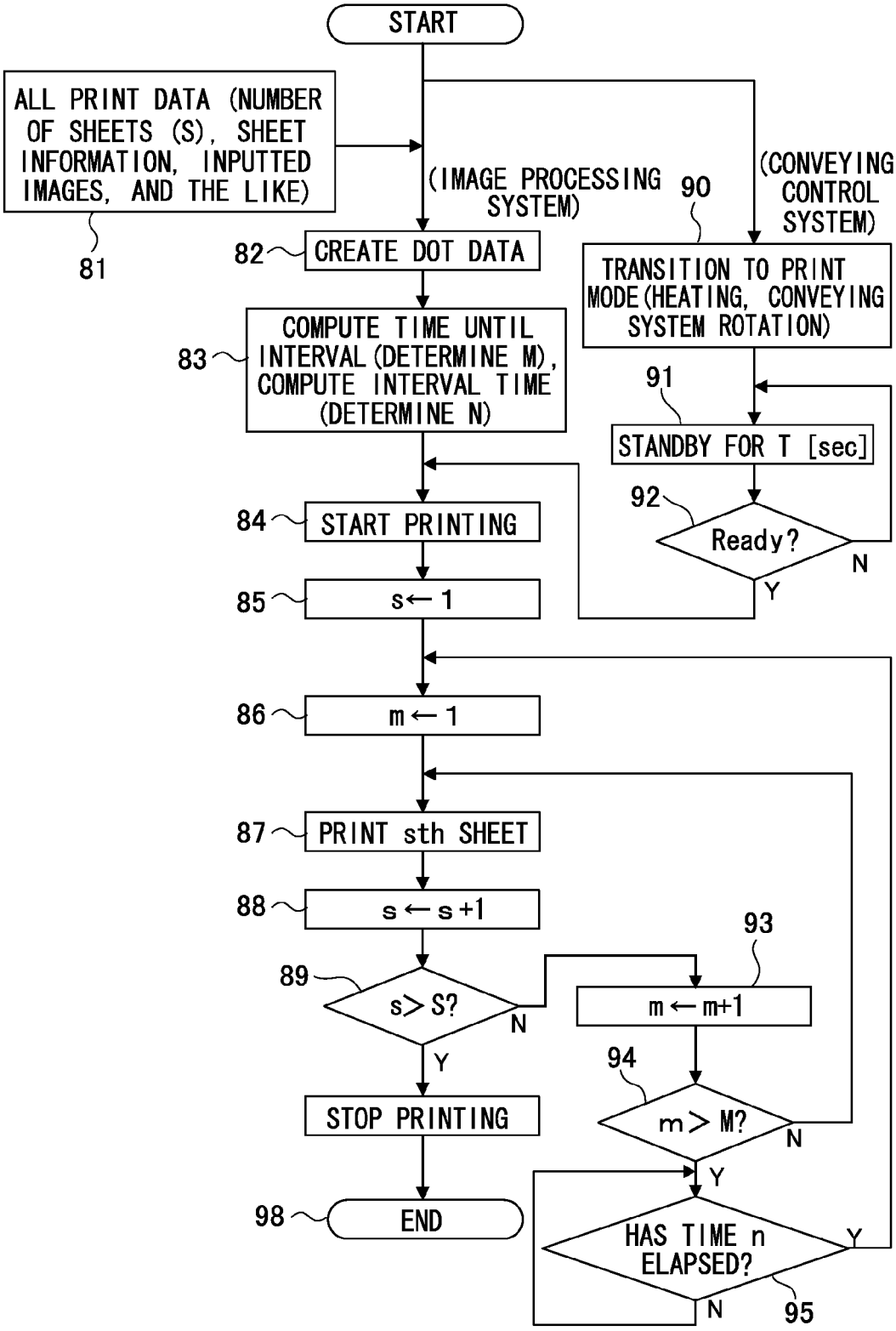
FIG. 5 is a flowchart showing the order of processings in accordance with the image formation device relating to the first exemplary embodiment of the present invention.

Next, the processing routine of a program executed by the control section 70 of the present exemplary embodiment is described by using the flowchart of FIG. 5.

First, when the power of the image formation device 100 is turned on and operation is started, all of the information needed for printing, such as inputted images that are inputted from the input section 20, a designated number of sheets to be printed (number of sheets S), the sheet (recording medium) size, and the like are fetched (step 81).

Next, an image processing system carries out image conversion on the basis of information of the inputted images, and creates dot data (step 82).

Next, information, that is the continuously printed number of sheets M that are to be continuously printed, and the stoppage time t over which printing is to be stopped temporarily after the continuous printing, are computed as printing processing information (step 83). The methods of computation thereof are described later.

Note that the information of the stoppage time t may be the time information t as is, or, a number of sheets N in terms of recording media (an integer value) may be computed by dividing the stoppage time t by the printing time per one sheet, and the information of the stoppage time t may be this number of sheets N in terms of recording media.

On the other hand, when the start of printing is instructed, a series of conveying control systems that convey the sheet transition from a warm-up mode to a printing mode (print mode) in which printing is possible (step 90). Concretely, rotation of an impression cylinder is increased to the printing speed, and the temperatures of the drying section 38 and the fixing section 122 are raised to the printing temperatures (refer to FIG. 1).

Next, at each fixed time (called T), the conveying control systems detect whether or not the conveying control systems have entered into conveyable states (ready states) (concretely, whether or not the conveying speed and the operation of the drying section have reached predetermined values, or the like). If these states fall within predetermined ranges, it is judged that the systems are in ready states, and ready information is outputted (steps 91, 92).

Next, after it is confirmed that creation of the dot data of the inputted images at the image processing system has ended and that the conveying control systems are in ready states, printing is started (step 84).

In the printing, given that the cumulative printed number of sheets until now is s and that the number of sheets printed after the stoppage time is m, s=1 is inputted as the printed number of sheets until now and m=1 is inputted as the printed number of sheets after the stoppage time, at the point in time of the start of printing (the printing of the first sheet) (steps 85, 86).

After printing of the first sheet is carried out (step 87), 1 is added to the printed number of sheets s until now (step 88). Here, if the condition that the printed number of sheets s until now>the designated printed number of sheets S is satisfied, printing is stopped (step 98). If the condition that the printed number of sheets s until now>the designated printed number of sheets S is not satisfied, 1 is added to the post-stoppage time printed number of sheets m (step 93).

Next, if the post-stoppage time printed number of sheets m exceeds the continuously printed number of sheets M, printing of the set number of sheets ends, and therefore, the stoppage time t is provided (steps 94, 95). The method of computing the stoppage time t is described later.

After the stoppage time t ends, the next printing is started again. Namely, the printed number of sheets m is made to be m=1 (step 86), and the next printing is carried out.

The next printing is carried out by similar processes until the post-stoppage time printed number of sheets m exceeds the continuously printed number of sheets M.

The inkjet recording head 22 is described next.

Figure 6:
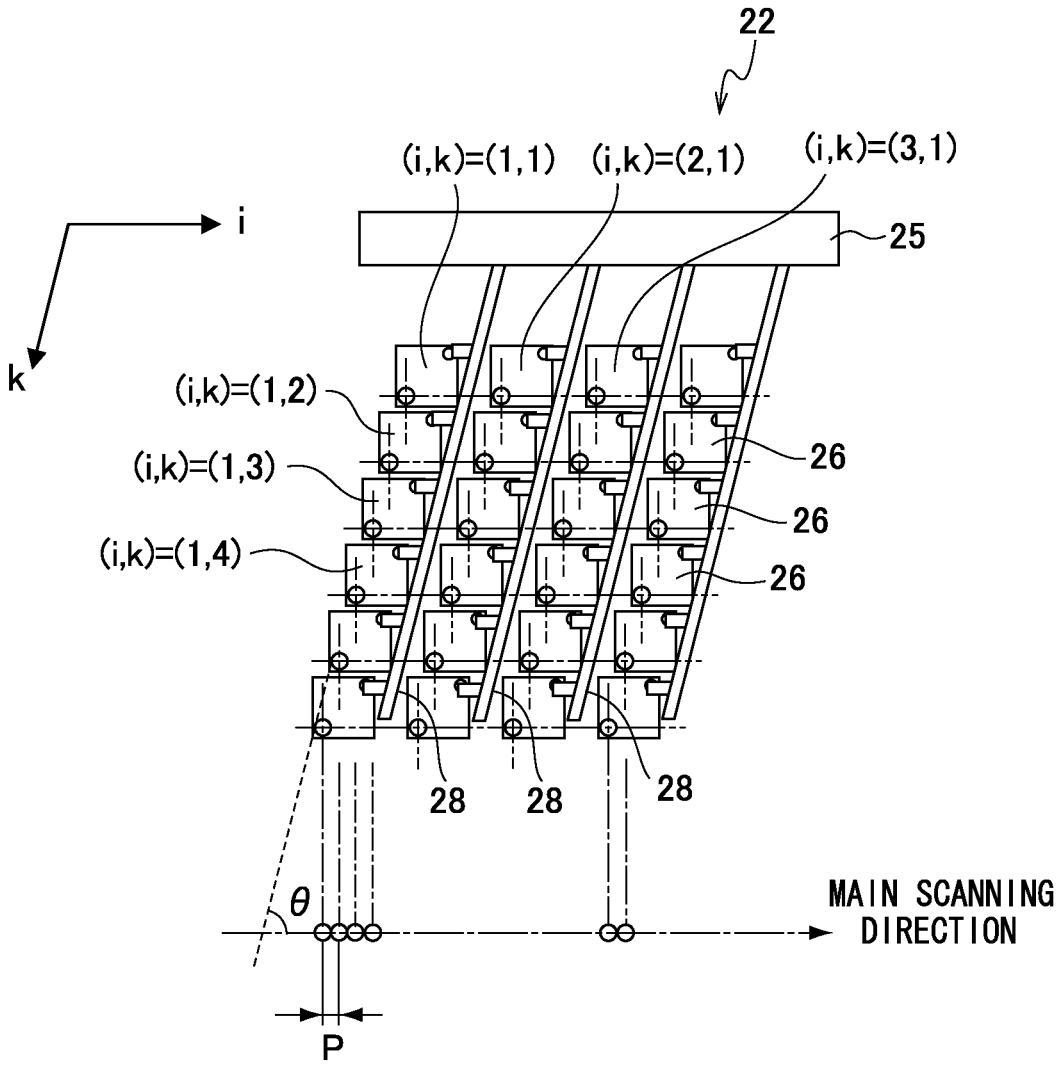
FIG. 6 is a partial enlarged view showing the basic structure of a droplet ejecting head of the image formation device relating to the first exemplary embodiment of the present invention.

As shown in the partial enlarged view of FIG. 6, the inkjet recording head 22 has a common flow path 25 into which ink is filled, and I branches 28 are forked-off from the common flow path 25 (i=1, 2, . . . , I). Further, K nozzles 26 are provided at each of the branches 28 (k=1, 2, . . . , K).

Therefore, in order to specify the plural nozzles 26 and branches 28, numerals i,k are added thereto as needed. Namely, branch 28*i* means the ith branch. Nozzle 26(*i,k*) means the nozzle that is mounted to the ith branch and that is the kth nozzle when counted from the common flow path 25 side.

The method of determining the continuously printed number of sheets M (the number of sheets to be printed until the next stoppage time) is described next.

Information of the continuously printed number of sheets M, that is set in advance, is stored as a fixed value in the data accumulating section 72. By using this fixed value, continuous printing of M sheets can be implemented.

However, in order to ensure stable throughput without giving rise to poor ejection from the nozzles 26, a method of computing by using dot data, which method is described hereinafter, is more accurate and is preferable.

The method of determining the fixed value is described next by using the trial computation tables shown in FIGS. 7A and 7B. In both of these trial computation tables, trial computation is carried out by using a converted ink amount of a case that assumes printing of output images of a standard printing density.

Figure 7A:
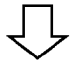
FIG. 7A is an explanatory diagram showing trial computation examples of a converted ink amount per flow path of the image formation device relating to the first exemplary embodiment of the present invention.

FIG. 7A is an example of a case of printing continuously without providing stoppage times, and FIG. 7B is an example of a case of providing a stoppage time at a predetermined interval.

In both of the trial computation tables, the numbers of sheets that are printed (as examples, one sheet to 31 sheets) are listed in the horizontal row of the trial computation table, and the branches i (i=1 to 6) that supply ink are listed in the vertical column. Further, the columns of the branches i are divided vertically, and the converted ink amount, that digitizes the ink amount of the sth page per one sheet, is given in the upper column of each branch i. Here, the converted ink amount means the proportion given that the ink amount in a case of recording on one sheet densely is 100.

The cumulative value up through sheet s after the stoppage time is given in the lower column of each branch i.

Further, the lowest row of the branches i lists the maximum value of all of the branches i for each printed number of sheets. Here, FIGS. 7A and 7B are an example in a case of printing a separate image on each sheet (and accordingly, the ink amount per sheet differs).

As shown in FIG. 7A, when no stoppage time is provided, the converted ink amount of each branch i increases as the printed number of sheets s increases. Therefore, when the converted ink amount exceeds the threshold value of each branch i, the supply of ink is insufficient, and poor ejection of the nozzles arises.

For example, in a case in which the threshold value of the converted ink amount is made to be 900 for example from experimental values, when the number of printed sheets is greater than or equal to 14, flow paths that exceeds the threshold value of 900 arise (refer to branch 3 through branch 5, and the shaded portion in the lowest column).

Accordingly, in this case, a stoppage time must be provided before the printed number of sheets becomes 14, and the continuously printed number of sheets M is 13.

As shown in FIG. 7B, by providing a stoppage time before the threshold value 900 of the converted ink amount is exceeded, the occurrence of poor ejection of nozzles can be suppressed.

Concretely, a stoppage time is provided at the point in time (shown by t1) when the printed number of sheets reaches 13 sheets. At this time, the stoppage time is provided such that printing is stopped for a time corresponding to a case in which the printed number of sheets is one sheet.

Due thereto, printing is restarted in a state in which the count is cleared to zero. Also after printing is restarted, a stoppage time is provided at the point in time when the printed number of sheets reaches 13.

In this way, by providing stoppage times appropriately, even if printing is carried out continuously in succession after the stoppage time (31 sheets in FIG. 7B), the threshold value 900 is not exceeded, and the occurrence of poor ejection of the nozzles can be suppressed.

Note that it is also possible to adopt a predicting method of predicting the ejected ink amount and correcting the fixed value, and providing a stoppage time immediately before the threshold value 900 of the converted ink amount is exceeded (shown by t2). Due thereto, the stoppage time can be reduced.

The method of determining the stoppage time t is described next.

In the determination of the stoppage time t, the stoppage time t is determined by computing time T needed in order to eliminate the insufficiency of the supply of ink at all of the branches 28*i* (see FIG. 6).

Note that, from the standpoint of improving the total throughput, it is desirable to make the stoppage time t be the time (the number of sheets N in terms of recording media) that is needed in order to print one sheet for output.

Namely, the number of sheets N in terms of recording media is determined by dividing the stoppage time t by time p needed in order to print one sheet (N=t/p). At this time, the number of sheets N in terms of recording media is a natural number multiple (N times, where N is a natural number) of the printing time per one sheet.

As described above, printing, for a time corresponding to the printing of N sheets by the inkjet recording head 22, is stopped during the stoppage time. At this time, sheets may be continuously fed from the sheet feeding section and only printing by the recording head may be stopped, so that blank sheets are discharged as a result. However, by stopping the sheet feeding section 24 as well, wasteful conveying of sheets can be suppressed.

Note that, during the stoppage time, the conveying control system stands-by in the print mode as is, without transitioning to the warm-up mode. Namely, the speed of the impression cylinder, and the operations of the drying section 38 and the fixing section 122 remain as is in the print mode (hereinafter, "the drying section 38" is written representatively for the drying section 38 and the fixing section 122). As a result, the usual printing operation (the printing of the next continuously printed number of sheets M) can be started immediately after the number of sheets N in terms of recording media has passed (see FIG. 5).

The above-described present exemplary embodiment is executed as follows. Note that the contents of the respective steps have already been described, and detailed explanation is omitted.

First, the image converting section executes a step of converting inputted images into dot data.

Next, the printing processing section executes a step of, from inputted print information, outputting continuously printed sheet number information that causes the inkjet recording head 22 to continuously form output images, and stoppage time information that causes the inkjet recording head 22 to stop the printing of output images.

Next, the control section 70 executes a step of printing the continuously printed number of sheets M, and, thereafter, in the stoppage time, stopping at least the inkjet recording head 22, and continuously driving the conveying section 14 (see FIG. 3 and FIG. 5).

As described above, in the present exemplary embodiment, stoppage time of the inkjet recording head 22 is ensured, and the occurrence of poor ejection from the nozzles 26 is suppressed.

Moreover, because the conveying section 14 continues the conveying operation even during the stoppage time, a delay in printing, that is needed for shut-down and start-up of the conveying section 14 before and after the inkjet recording head 22 is stopped (a delay in printing due to conveying preparations), is suppressed, and throughput of printing is ensured.

Second Exemplary Embodiment

Figure 8:
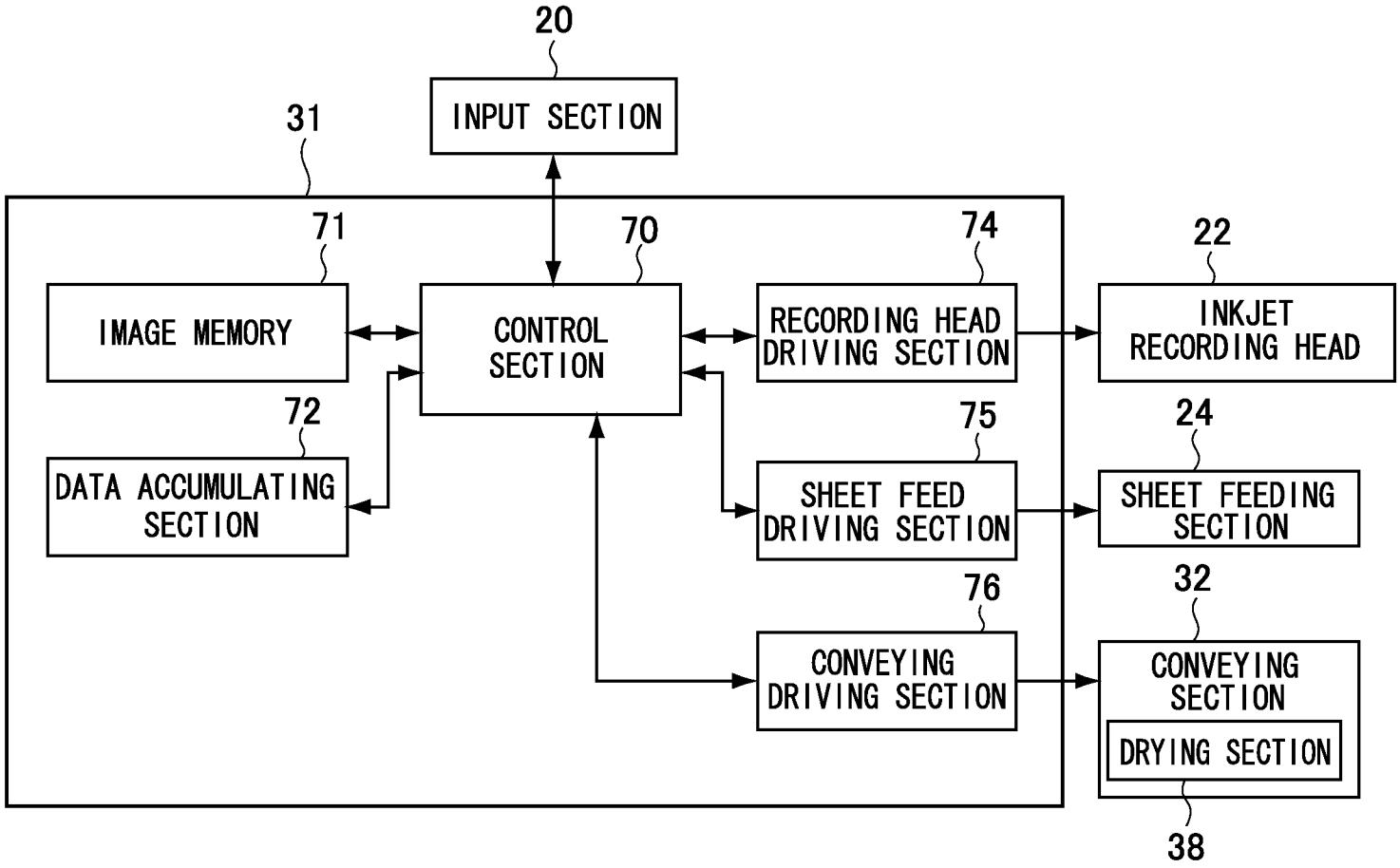
FIG. 8 is a block diagram showing the basic structure of a control device of an image formation device relating to a second exemplary embodiment of the present invention.

An image formation method relating to a second exemplary embodiment is a method of controlling an image formation device by a control device 31 that is shown in the block diagram of FIG. 8. At the control device 31, the drying section 38 that dries sheets is provided at a conveying section 32. The second exemplary embodiment differs from the first exemplary embodiment with regard to the point of having the drying section 38.

The drying section 38 is provided at the conveying direction downstream side of the inkjet recording head 22, and dries printed sheets while conveying them (see FIG. 1).

The control section 70 has a drying operation control processing function, and controls the operation of the drying section 38. Concretely, for example, the control section 70 switches between a first temperature that maintains the printing temperature set during printing at the drying section 38, and a second temperature that is set to a temperature lower than the first temperature.

The drying operation control processing function maintains the drying section 38 continuously at the first temperature during the stoppage time.

Note that, in the present example, control of the temperature is given as a concrete form of the drying operation control, but the drying operation control is not limited to temperature. For example, an IR heater may be provided as the drying means, and control of the duty thereof or the like may be the drying operation control. At this time, the above "first temperature, and second temperature that is set to a temperature lower than the first temperature" can be read as "first operation, and second operation of a lower drying energy than the first operation".

Further, the control section 70 has an image processing function. In the method described hereinafter, the control section 70 computes the continuously printed number of sheets M and the number of sheets N in terms of recording media.

A structure in which the conveying section, at which the drying section 38 is provided, has plural regions that can convey output sheets as shown in FIG. 1 is described next. Namely, at the drying section 38, a number P of conveying regions that can convey the output sheets 154 is two (a 2× drum), and two of the sheets 154 can be conveyed by a single rotation.

In the image processing, given that the number of conveying regions is P (P≥2), and that the continuously printed number of sheets is M, and that the number of sheets in terms of recording media, that is obtained by dividing the stoppage time by the printing time per one recording medium, is N, the control section 70 determines the number P of the conveying regions, the continuously printed number of sheets M, and the number of sheets N in terms of recording media such that following formula (1) is satisfied.

$$n(\text{mod } \alpha)=0 \quad (1)$$

where n: the remainder when N is divided by P (n=N(modP))

α: the greatest common factor of P and (M+N)

Due thereto, it is investigated whether or not the remainder n, when the number of sheets N in terms of recording media is divided by the number P of conveying regions, is divisible by the greatest common factor α of the number P of conveying regions and (the continuously printed number of sheets M+the number of sheets N in terms of recording media), i.e., it is investigated whether or not n(mod α)=0. By employing the condition that the remainder n is divisible by the greatest common factor α, at the drying section 38, a situation in which only a specific drying/conveying section continues to be heated does not occur, and the states (curled states) of the outputted sheets can be kept substantially uniform.

Namely, during the stoppage time, the drying section 38 remains as is in the print mode, and the conveying section 32 itself is overheated without sheets arriving thereat. Therefore, if the aforementioned condition is not satisfied, only the specific conveying section 32 continues to be overheated. When the temperature of the conveying section 32 at the drying section 38 changes, the dried state (curled state) of the sheet that is conveyed changes, and therefore, the curled state changes per sheet. As a result, the sheets cannot be made into a uniformly printed state.

In contrast, by satisfying the aforementioned condition, a situation in which only the specific conveying section 32 continues to be overheated does not occur, and the curled state per sheet can be made to be uniform.

Evaluation of overheating is shown in the dried state analysis table of FIG. 9. Time that has elapsed from the start of printing (time that is standardized with the time for printing one sheet being 1) is shown in the horizontal rows of FIG. 9, and 10 conditions that were studied (6 conditions of Examples, and four conditions of Comparative Examples) are shown in the vertical columns.

Here, the numbers 2 through 4 in the vertical column entitled "P" represent the number P of conveying regions. The numbers 12 through 14 in the vertical column entitled "M" represent the continuously printed number of sheets. The numbers 1 through 3 in the vertical column entitled "N" represent the number of sheets in terms of recording media.

Further, the ten conditions that were studied are divided into upper and lower rows. The upper row is a row showing the absence/presence of printing, and the lower row is a row showing the drying section.

In the horizontal row entitled "printing absence/presence", the "P" mark represents printing and the "D" mark represents stoppage time (down time). The row entitled "drying section" lists abbreviations of the conveying regions of the drying section. When the number P of conveying regions is 2 (a 2× drum) for example, the horizontal row entitled "drying section" lists A and B in order to differentiate between the conveying regions.

Further, in order to check overheating during the stoppage time, the positions (shown by A and B when the number P of conveying regions is 2) of the conveying regions corresponding to stoppage times are shaded.

From the dried state analysis table of FIG. 9, in Examples 1 through 6, the positions of the conveying regions in the stoppage times are well balanced and alternate successively. As a result, it is judged that the curled state per sheet can be made to be uniform.

On the other hand, in Comparative Examples 1 through 4, the positions of the conveying regions at the stoppage times tend toward the same region, and only a specific region is overheated, and it is judged that the sheets become curled.

As noted in the "notes" columns in FIG. 9, if aforementioned formula (1) is satisfied, namely, if the condition n(mod α)=0 is satisfied, a situation in which only a specific region of the conveying section becomes high temperature does not arise.

Note that FIG. 9 is an example, and the relationship between the number P of the conveying regions, the continuously printed number of sheets M and the number of sheets N in terms of recording media is not limited to that shown in FIG. 9.

In the above-described example, it is good to make a non-conveying rate r (r=N/(M+N)×100) be less than 50%. Here, M is the continuously printed number of sheets, and N is the number of sheets in terms of recording media.

This is because, even if formula (1) is satisfied, if the proportion of not conveying output sheets while having transitioned to the print mode is high, the temperature of the drying section 38 (in a case in which the drying section 38 has plural conveying sections, all of these conveying sections) becomes too high on the whole, and overdrying occurs.

Other points are the same as those of the first exemplary embodiment, and description thereof is omitted.

Third Exemplary Embodiment

Figure 10:
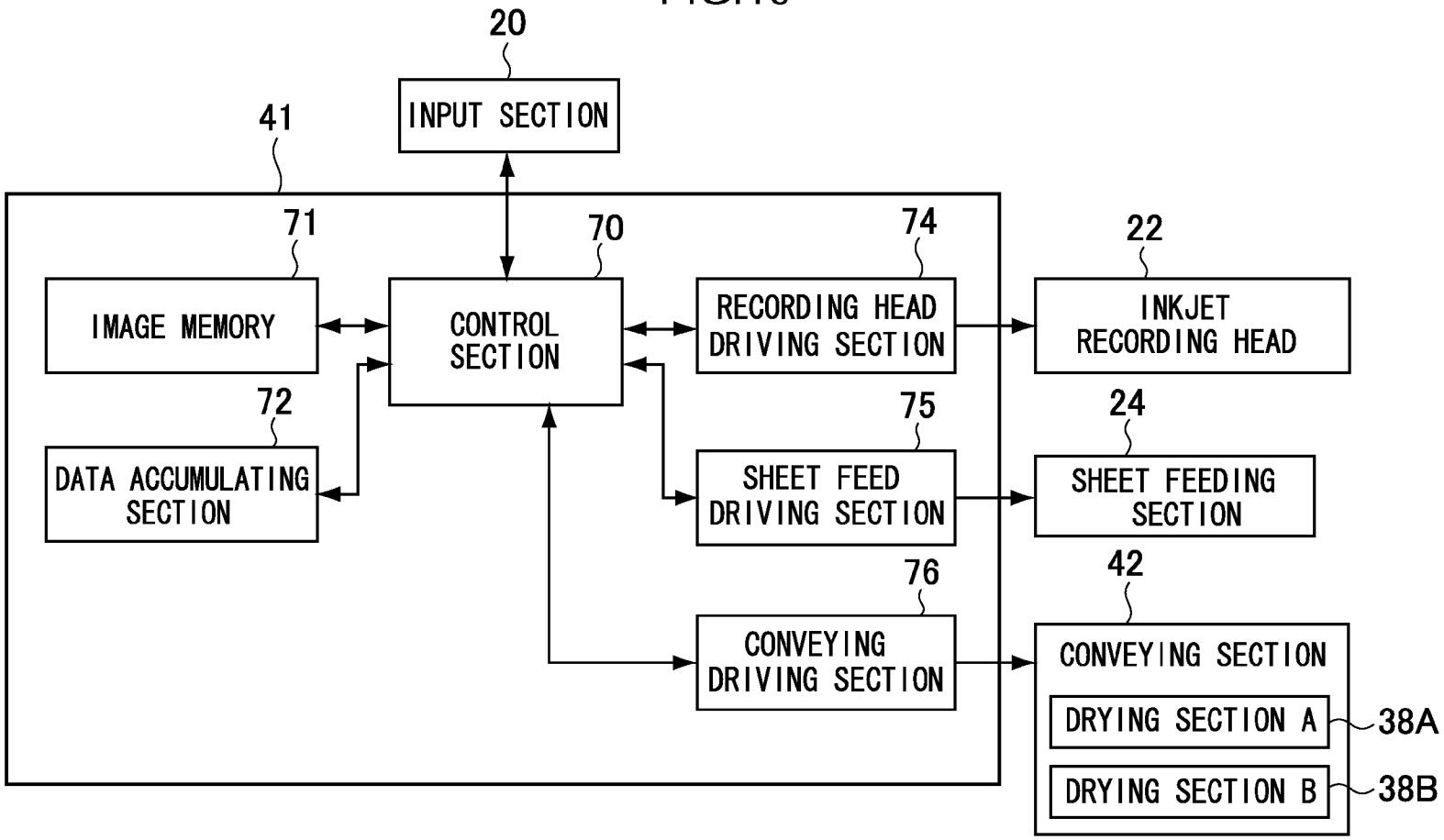
FIG. 10 is a block diagram showing the basic structure of a control device of an image formation device relating to a third exemplary embodiment of the present invention.

An image formation method relating to a third exemplary embodiment is a method of controlling an image formation device by a control device 41 that is shown in the block diagram of FIG. 10. At the control device 41, a plurality of the drying sections 38 that dry output sheets (in FIG. 10, two drying sections that are the drying section 38A and the drying section 38B) are provided at the conveying section 32. The third exemplary embodiment differs from the second exemplary embodiment in that the numbers of the drying sections 38 are different.

Although not illustrated, the drying sections 38A, 38B are both provided adjacent at the conveying direction downstream side of the inkjet recording head 22, and dry printed output sheets while conveying them.

The control section 70 has a drying operation control function, and controls the operations of the drying sections 38A, 38B. Concretely, the control section 70 switches between a first temperature that maintains a printing temperature at the drying sections 38A, 38B, and a second temperature that is set to a temperature lower than the first temperature.

Note that, in the present example, control of the temperature is given as a concrete form of the drying operation control, but, in the same way as in the second exemplary embodiment, the object of control is not limited to temperature. For example, an IR heater may be provided as the drying means, and control of the duty thereof or the like may be the drying operation control. At this time, the above "first temperature, and second temperature that is set to a temperature lower than the first temperature" can be read as "first operation, and second operation of a lower drying energy than the first operation".

Further, the control section 70 has a printing processing function, and computes the continuously printed number of sheets M and the number of sheets N in terms of recording media.

Here, there are a plurality of the drying sections 38. When the number of conveying regions respectively differs at the plural drying sections 38, in the printing processing, among the drying sections at which the number of conveying regions is greater than or equal to 2, given that the number of conveying regions at a jth drying section is $P_j$ ($P_j \geq 2$), and that the number of sheets in terms of recording media is N, and that the continuously printed number of sheets is M, the number $P_j$ of conveying regions, and the number of sheets N in terms of recording media, and the continuously printed number of sheets M are determined such that following formula (2) is satisfied.

$$n_j(\text{mod } \alpha_j)=0 \quad (2)$$

where $n_j$: the remainder when N is divided by $P_j$($n_j$=(mod$P_j$))

$\alpha_j$: the greatest common factor of $P_j$ and (M+N)

Due thereto, it is investigated whether or not the remainder $n_j$, when the number of sheets N in terms of recording media is divided by the number $P_j$ of conveying regions, is divisible by the greatest common factor $\alpha_j$ of the number $P_j$ of conveying regions and (the continuously printed number of sheets M+the number of sheets N in terms of recording media), i.e., it is investigated whether or not $n_j(\text{mod } \alpha_j)=0$. By employing the condition that the remainder $n_j$ is divisible by the greatest common factor $\alpha_j$, at the drying sections 38A, 38B, a situation in which only a specific drying/conveying section continues to be heated does not occur, and the states (curled states) of the outputted sheets can be kept substantially uniform.

Results of evaluation of the relationship between the continuously printed number of sheets and the number of sheets for which printing is stopped after continuous printing are shown in the analysis tables of FIGS. 11 and 12. The structures of FIGS. 11 and 12 are the same as that of the drying state analysis table of above-described FIG. 9, and description thereof is omitted. Note that, in the analysis tables of FIGS. 11 and 12, the number of drying sections is increased, and therefore, a portion corresponding thereto is added.

From the drying state analysis table of FIG. 11, in Examples 1 and 2, the positions of the conveying regions during the stoppage times are rotated in a well-balanced manner. Namely, conveying regions A, B and a, b, c alternate successively. As a result, the curled state per sheet can be made to be uniform.

On the other hand, in Comparative Examples 1 through 3, the positions of the conveying regions at the stoppage times tend toward the same region, and only a specific region is overheated. As a result, sheets become curled, which is not preferable.

Further, from the drying state analysis table of FIG. 12, in Examples 1 through 3, the positions of the conveying regions during the stoppage times are rotated in a well-balanced manner. Namely, conveying regions A, B, conveying regions a, b, c, and conveying regions α, β, γ, δ alternate successively. As a result, the curled state per sheet can be made to be uniform.

On the other hand, in Comparative Examples 1 and 2, the positions of the conveying regions at the stoppage times tend toward the same region, and only a specific region is overheated, and output sheets become curled, which is not preferable.

As noted in the "notes" columns in FIGS. 11 and 12, if aforementioned formula (2) is satisfied, namely, if $n_j(\text{mod } \alpha_j)=0$, a situation in which only a specific region of the conveying regions becomes high temperature does not arise.

Note that FIGS. 11 and 12 are examples, and the relationship between the number P of the conveying regions, the continuously printed number of sheets M and the number of sheets N in terms of recording media is not limited to that shown in FIGS. 11 and 12.

Other points are the same as those of the second exemplary embodiment, and description thereof is omitted.

Fourth Exemplary Embodiment

An image formation method relating to the fourth exemplary embodiment is a method of determining the continuously printed number of sheets M by using a maximum ejected ink total amount Vmax. The fourth exemplary embodiment differs from the third exemplary embodiment with regard to the point of using the maximum ejected ink total amount Vmax.

As shown in the partial enlarged view of FIG. 6, the droplet ejecting head 138 has the common flow path 25, and the respective branches 28 are branched-off therefrom, and ink is supplied from the branches 28 to the nozzles 26. Here, an arbitrary branch 28*i* (where i is a numeral representing the ordinal number of the branch) is studied.

At this time, if a large amount is ejected from the arbitrary branch 28*i*, there are cases in which the amount of ink that is supplied to that branch 28*i* is insufficient, and poor ejection arises at the nozzles that are connected to the branch 28*i*. Accordingly, the total ink amount ejected from the branch 28*i* per one sheet is Vi, and a maximum value Vmax among the ejected ink total amounts Vi is determined (maximum value Vmax=max{Vi}).

For example, given that the maximum value Vmax of the ejected ink total amounts Vi per one sheet is 100, it suffices that the continuously printed number of sheets M be determined as follows.

Namely,

TABLE 1

| Vmax | continuously printed number of sheets M |
|---|---|
| greater than or equal to 0 and less than 50 | not prescribed (a maximum number of printed sheets that the user can designate) |
| greater than or equal to 50 and less than 70 | 50 |
| greater than or equal to 70 and less than 90 | 30 |
| greater than or equal to 90 | 10 |

Further, as another method, given that the maximum ejected ink total amount is Vmax, and that the total amount of ink that can be ejected such that continuous printing is possible at the branch at which the maximum ejected ink total amount Vmax has arisen is V, a printing processing section 16 determines the continuously printed number of sheets M such that the maximum ejected ink total amount Vmax does not exceed the total amount V of ink that can be ejected such that continuous printing is possible.

Due thereto, poor printing that is predicted at the nozzles 26 connected to the respective branches 28 can be dealt with appropriately by simple computation.

Other contents of control are the same as the third exemplary embodiment, and description thereof is omitted.

Fifth Exemplary Embodiment

The image formation method relating to the fifth exemplary embodiment is a method of determining the continuously printed number of sheets M in accordance with the average ejected ink total amount of the top R ejected ink total amounts in order from the greatest to the least ejected ink total amount.

The fifth exemplary embodiment differs from the fourth exemplary embodiment with respect to the point that the average ejected ink total amount of the greatest R ejected ink total amounts is used. This point that differs from the fourth exemplary embodiment is described.

As described in the fourth embodiment, the ejected ink total amounts from the branches i are V1, V2, . . . , Vi, . . . , VI. A number R of the greatest among these ejected ink total amounts Vi are fetched, and the values of these ejected ink total amounts Vi are averaged, and the average ejected ink total amount that is computed is Vave (see FIG. 6).

Given that the average ejected ink total amount is Vave, and that the total amount of ink that can be ejected such that continuous printing is possible at the branches at which the average ejected ink total amount Vave has arisen is V, the printing processing section 16 determines the continuously printed number of sheets M on the basis of the average ejected ink total amount Vave and the total amount V of ink that can be ejected such that continuous printing is possible at the branches.

Due thereto, poor printing that is predicted at the nozzles connected to the respective branches can be dealt with more effectively by simple computation.

Note that, in the present example, the average value of the greatest R ejected ink total amounts is used as Vave. However, the present invention is not limited to the same, and a weighted average may be used.

Other points are the same as the fourth exemplary embodiment, and description thereof is omitted.

Sixth Exemplary Embodiment

An image formation method relating to the sixth exemplary embodiment is a method of determining the continuously printed number of sheets M on the basis of the arrayed order from the upstream side of the common flow path.

The sixth exemplary embodiment differs from the fourth exemplary embodiment with regard to the point that the arrayed order of the branches is used. The point that differs from the fourth exemplary embodiment is described.

As shown in the partial sectional view of FIG. 6, the branches that are mounted to the common flow path of the droplet ejecting head 138 are disposed from the upstream toward the downstream direction of the ink.

Due thereto, differences arise in the flow rates of ejection from the respective branches. By taking these differences into consideration, the effects of poor ejection, that is predicted at the connected nozzles, can be estimated more effectively and can be dealt with appropriately.

Concretely, the effects can be estimated more effectively by determining an ejectable ink total amount V by multiplication by a factor that is set on the basis of the arrayed order from the upstream side of the common flow path.

Moreover, it is more preferable to apply weights when computing the ejected ink total amounts Vi, in accordance with the positions of the nozzles within a same branch as well.

For example, given that K nozzles that are common to the branch i are k=1, 2, . . . , K in order from the ink supply side, and that the Kth ejection amount of ink of the ith branch is $V^i_k$, the ejected ink total amount Vi is computed by following formula (3).

$$Vi = \sum_{k=1}^{k} \alpha(k) V_k^i \tag{3}$$

Here, α(k) is a weighting parameter that satisfies the following condition:

for k=1, 2, . . . , K−1, $0 \le \alpha(k) \le \alpha(k+1)$

Namely, α(k) is a weighting parameter that is such that, the greater the subscript k, the larger the value of the ejected ink total amount Vi.

Due thereto, the point that, the further away a nozzle is from the ink supply side even in the same branch i, the more difficult it is for ink to be ejected, is taken into consideration, and poor ejection can be suppressed.

Note that $V^i_k$ is the ink amount that the nozzle k, that is connected to flow path i, ejects per one output sheet.

Other points are the same as the fourth exemplary embodiment, and description thereof is omitted.

Seventh Exemplary Embodiment

The image formation method relating to the seventh exemplary embodiment relates to a method of determining the continuously printed number of sheets M in a case in which the inkjet recording head 22, that is described in the first exemplary embodiment, continuously prints different output images.

The seventh exemplary embodiment differs from the first exemplary embodiment with regard to the point that the output images that are continuously printed differ at each output sheet. Explanation is given centering on this differing point.

In a case in which the inkjet recording head 22 continuously prints different images, when a different image is printed per sheet, the printing processing section 16 adds-up the ejected ink total amount Vi, up through the sth sheet from the start of printing, at the ith branch, and this value is cumulative ink ejection amount Vit. Next, the printing processing section 16 determines the continuously printed number of sheets M within a range in which the cumulative ink ejection amount Vit does not exceed the ejectable ink total amount V at which continuous printing is possible at the branch.

Due thereto, even when different images are printed, poor ejection, that is predicted at the nozzles connected to the respective branches, can be dealt with appropriately by simple computation.

What is claimed is:

1. An image formation device comprising:

a recording medium supplying section that supplies a recording medium;

a conveying section that conveys the recording medium supplied from the recording medium supplying section;

an image formation section that ejects droplets and forms an image on the recording medium that is being conveyed;

an image conversion section that converts an inputted image into dot data;

a printing processing section that, from inputted print information, outputs continuously printed number of sheets information that causes the image formation section to continuously print output images, and prints the recording media corresponding to the continuously printed number of sheets, and, thereafter, carries out processing that temporarily stops printing of the output images; and a control section that, during a stoppage time of the printing, stops at least formation of images at the image formation section, and continues to drive the conveying section wherein the printing processing section computes the continuously printed number of sheets and the stoppage time on the basis of the dot data.

2. The image formation device of claim 1, wherein a drying section, that dries the recording medium while conveying the recording medium, is provided at a conveying direction downstream side of the image formation section, the control section has a drying operation control section that switches operation of the drying section between a first operation at a time of printing, and a second operation at a time of warm-up at which drying energy is lower than drying energy of the first operation, and the drying operation control section continues to maintain the drying section in the first operation during the stoppage time.

3. An image formation method comprising:

a step in which an image conversion section converts an inputted image into dot data;

a step in which a printing processing section, from inputted print information, outputs continuously printed number of sheets information that causes an image formation section to continuously form output images, and prints the continuously printed number of sheets, and, thereafter, outputs stoppage time information that stops printing of the output images;

a step in which a control section executes printing of the continuously printed number of sheets by causing a recording media supplying section to supply recording media, and causing a conveying section to convey the recording media, and causing the image formation section to form images on the recording media by a droplet ejection head; and a step in which the control section, after printing the continuously printed number of sheets, during the stoppage time, stops at least formation of images at the image formation section, and continues to drive the conveying section wherein the printing processing section computes the continuously printed number of sheets and the stoppage time on the basis of the dot data.

4. The image formation method of claim 3, wherein a drying section, that dries the recording media while conveying the recording media, is provided at a conveying direction downstream side of the image formation section, and the drying section has a plurality of conveying regions on which the recording media are conveyed, and given that a number of the conveying regions is P, where $P \geq 2$, and that the continuously printed number of sheets is M, and that a number of sheets in terms of recording media, that is obtained by dividing the stoppage time by a printing time per recording medium, is N, the printing processing section determines the number P of the conveying regions, the continuously printed number of sheets M, and the number of sheets N in terms of recording media so as to satisfy following formula (1):

$$n(\text{mod } \alpha)=0 \quad (1)$$

where n: a remainder when N is divided by P ($n=N(\text{mod}P)$)

$\alpha$: a greatest common factor of P and (M+N).

5. The image formation method of claim 3, wherein a plurality of drying sections, that dry the recording media while conveying the recording media, are provided at a conveying direction downstream side of the image formation section, and the plurality of drying sections have one or more conveying regions on which the recording media are conveyed, and given that a number of the conveying regions at a jth drying section, among drying sections whose number of the conveying regions is greater than or equal to 2, is $P_j$ ($P_j \geq 2$), and that a number of sheets in terms of recording media, that is obtained by dividing the stoppage time by a printing time per one recording medium, is N, and that the continuously printed number of sheets is M, the printing processing section determines the number $P_j$ of the conveying regions, the number of sheets N in terms of recording media, and the continuously printed number of sheets M so as to satisfy following formula (2):

$$n_j(\text{mod } \alpha_j)=0 \quad (2)$$

where $n_j$: a remainder when N is divided by $P_j$ ($n_j=(\text{mod}P_j)$)

$\alpha_j$: a greatest common factor of $P_j$ and (M+N).

6. The image formation method of claim 3, wherein the droplet ejecting head has i branches that are branched-off from a common flow path, and k nozzles provided at each of the branches, and given that an ejected ink total amount of an ith (i=1, 2, . . . , I) branch that is computed on the basis of the dot data is $V_i$, the printing processing section determines the continuously printed number of sheets M on the basis of the ejected ink total amount $V_i$ and an ejectable ink total amount V at which continuous printing is possible at the branch.

7. The image formation method of claim 6, wherein, given that a maximum value among the ejected ink total amounts $V_i$ is maximum ejected ink total amount Vmax, the printing processing section determines the continuously printed number of sheets M on the basis of the maximum ejected ink total amount Vmax and the ejectable ink total amount V at which continuous printing is possible at the branch.

8. The image formation method of claim 6, wherein, given that an average of R ejected ink total amounts $V_i$, that are selected in order from a greatest ejected ink total amount among the ejected ink total amounts $V_i$, is average ejected ink total amount Vave, the printing processing section determines the continuously printed number of sheets M on the basis of the average ejected ink total amount Vave and the ejectable ink total amount V at which continuous printing is possible at the branches.

9. The image formation method of claim 6, wherein the ejectable ink total amount V is determined by multiplication by a factor that is determined on the basis of an arrayed order from an upstream side of the common flow path.

10. The image formation method of claim 9, wherein, given that K nozzles that are common to a branch are k=1, 2, . . . , K in order from the common flow path, and that an ink ejection amount from a Kth nozzle of an ith branch is $V^i_k$, the ejected ink total amount Vi from the branch is computed by following formula (3):

$$Vi = \sum_{k=1}^{k} \alpha(k) V_k^i \tag{3}$$

where $\alpha(k)$ is a weighting parameter that satisfies the following:

for k=1, 2, . . . , K−1, $0 \leq \alpha(k) \leq \alpha(k+1)$.

11. The image formation method of claim 3, wherein the droplet ejecting head has i branches that are branched-off from a common flow path, and k nozzles provided at each of the branches, and given that an ejected ink total amount of an ith (i=1, 2, . . . , I) branch that is computed on the basis of the dot data is $V_i$, when printing a different image per recording medium, the printing processing section adds-up the ejected ink total amounts Vi, from a start of printing through an sth recording medium, of the ith branch so as to compute a cumulative ink ejection amount Vit, and the printing processing section makes M be a continuously printed number of sheets at which the cumulative ink ejection amount Vit does not exceed the ejectable ink total amount V at which continuous printing is possible at the branch.

* * * * *